United States Patent [19]

Tani et al.

[11] Patent Number: 4,741,995

[45] Date of Patent: May 3, 1988

[54] SILVER HALIDE COLOR PHOTOGRAPHIC LIGHT-SENSITIVE MATERIAL

[75] Inventors: Tadaaki Tani; Mikio Ihama; Kiyoshi Nakazyo, all of Kanagawa, Japan

[73] Assignee: Fuji Photo Film Co., Ltd., Kanagawa, Japan

[21] Appl. No.: 856,556

[22] Filed: Apr. 28, 1986

[30] Foreign Application Priority Data

Apr. 26, 1985 [JP] Japan ..... 60-90390

[51] Int. Cl.[4] ..... G03C 7/38; G03C 1/12; G03C 1/19

[52] U.S. Cl. ..... 430/558; 430/569; 430/570; 430/581; 430/592; 430/588; 430/585

[58] Field of Search ..... 430/569, 558, 570, 581, 430/591, 592, 593, 594, 588, 585

[56] References Cited

U.S. PATENT DOCUMENTS

| | | | |
|---|---|---|---|
| 4,225,666 | 9/1980 | Locker et al. | 430/569 |
| 4,540,654 | 9/1985 | Sato et al. | 430/381 |
| 4,551,424 | 11/1985 | Ikeda et al. | 430/591 |
| 4,576,910 | 3/1986 | Hirano et al. | 430/558 |
| 4,618,573 | 10/1986 | Okamura et al. | 430/558 |
| 4,683,193 | 7/1987 | Ihama et al. | 430/570 |
| 4,693,965 | 9/1987 | Ihama et al. | 430/588 |

*Primary Examiner*—Paul R. Michl
*Assistant Examiner*—Lee C. Wright
*Attorney, Agent, or Firm*—Sughrue, Mion, Zinn, Macpeak, and Seas

[57] ABSTRACT

A silver halide color photographic light-sensitive material comprising a support having thereon at least one silver halide emulsion layer, wherein the silver halide emulsion layer contains a silver halide emulsion which is spectrally sensitized by adding a spectral sensitizing dye prior to the completion of formation of silver halide particles and at least one kind of pyrazoloazole type magenta coupler represented by the following general formula (I):

(I)

wherein $R^1$ represents a hydrogen atom or a substituent; X represents a hydrogen atom or a group capable of being released upon a coupling reaction with an oxidation product of an aromatic primary amine developing agent; Za, Zb and Zc each represents a methine group, a substituted methine group, =N— or —NH—, one of the Za—Zb bond and the Zb—Zc bond being a double bond and the other being a single bond, and when the Zb—Zc bond is a carbon-carbon double bond, it may form a part of an aromatic ring; $R^1$ or X may also form a polymer including a dimer or more; and when Za, Zb or Zc is a substituted methine group, the substituted methine group may form a polymer including a dimer or more. The silver halide color photographic light-sensitive material has a good color forming property and excellent stability during production and preservation, and provides color images having improved color reproducibility and image preservability.

14 Claims, No Drawings

SILVER HALIDE COLOR PHOTOGRAPHIC LIGHT-SENSITIVE MATERIAL

FIELD OF THE INVENTION

The present invention relates to a silver halide color photographic light-sensitive material, and more particularly, to a silver halide color photographic light-sensitive material containing a combination of a magenta coupler and a sensitizing dye, which has a good color forming property and improved color reproducibility and image preservability and which is excellent in stability to lapse of time and production.

BACKGROUND OF THE INVENTION

A silver halide color photographic light-sensitive material comprises a support having coated thereon a multilayer light-sensitive component composed of three kinds of light-sensitive silver halide emulsion layers selectively sensitized so as to have sensitivity to blue light, green light and red light. For instance, in so-called color printing paper (hereinafter simply referred to as color paper), a red-sensitive emulsion layer, a green-sensitive emulsion layer and a blue-sensitive emulsion layer are usually coated on a support in this order from the exposure side, and further, between or above the light-sensitive layers, an intermediate layer for the purpose of preventing color mixing or absorbing ultraviolet light or a protective layer, etc. is provided.

On the other hand, in so-called color positive films, a green-sensitive emulsion layer, a red-sensitive emulsion layer and a blue-sensitive emulsion layer are ordinarily coated on a support in this order from the remote side of the support, that is, from the exposure side. In color negative films the arrangement of layers is widely varied. While it is generally recognized that a blue-sensitive emulsion layer, a green-sensitive emulsion layer and a red-sensitive emulsion layer are coated on a support in this order on the exposure side, in the case of photographic light-sensitive materials having two or more emulsion layers which have the same spectral sensitizing but different sensitivity from each other, between these emulsion layers there is sometimes an emulsion layer having a different spectral sensitivity, and thus, a bleachable yellow filter layer, an intermediate layer, a protective layer, etc. are provided.

In order to form color photographic images, exposed photographic light-sensitive material having light-sensitive layers containing these kinds of photographic couplers, e.g., yellow, magenta and cyan couplers respectively are subjected to color development processing with so-called color developing agents. At color development, oxidation products of aromatic primary amines cause the coupling reaction with couplers to form colored dyes. In such cases it is desirable to use couplers which have a good color forming property, that is couplers having a coupling speed as high as possible and providing a high color density within the limited developing time. Further, colored dyes formed are requested to be clear cyan, magenta and yellow dyes of less undesirable secondary absorption in order to provide color photographic images having excellent color reproducibility.

Moreover, it is desired that color photographic images formed have good preservability under various conditions. Such conditions of preservation include, for example, preservation in a dark place subjected to the influence of humidity or heat, and light irradiation by sun light or a room lamp, etc. Not only discoloration or fading of color images but also yellowing at white background areas are extremely severe problems.

In order to fulfill the above described requirements for color photographic light-sensitive materials, couplers play an important part as color image forming agents. Therefore, many proposals on modification of coupler structures have been made to improve such properties. As magenta couplers which are particularly important in view of visual sensitivity, 5-pyrazolone derivatives have hitherto been dominantly employed. However, color images formed from these pyrazolone couplers have undesirable absorptions in the blue light region and the red light region in addition to the desired green light region, and thus they do not have satisfactory performance. Further, since 5-pyrazolone derivatives are apt to cause yellowing with light exposure or under high humidity conditions, they are insufficient in view of image preservability.

On the contrary, the magenta couplers represented by the general formula (I) described hereinafter are excellent couplers since color images formed therefrom show a good light absorption characteristic and little yellowing in white background areas. However, these couplers tend to cause a decrease in the sensitivity at the time of development and such a tendency increases when a coating solution containing these couplers is allowed to stand for a long time during the production of photographic light-sensitive materials or the photographic light-sensitive materials after coating are preserved for a long period of time. Therefore, this is a severe problem when using these couplers in practice.

SUMMARY OF THE INVENTION

A general object of the present invention is, therefore, to provide a color photographic light-sensitive material in which the above described properties required for color photographic light-sensitive materials are satisfied at the same time.

More specifically, an object of the present invention is to provide a color photographic light-sensitive material having good color reproducibility which forms magenta color images of excellent light absorption characteristics.

Another object of the present invention is to provide a color photographic light-sensitive material which forms a color image having good fastness under preservation in a dark place and with light exposure and improved ability to the formation of stain at white background areas.

A further object of the present invention is to provide a color photographic light-sensitive material which exhibits no decrease in the sensitivity at the time of development.

A still further object of the present invention is to provide a color photographic light-sensitive material which does not change its photographic performance at the time lapse in the state of a coating solution during the production thereof or during preservation thereof after coating.

Other objects of the present invention will become apparent from the following detailed description and examples.

These objects of the present invention are achieved by a silver halide color photographic light-sensitive material comprising a support having thereon at least one silver halide emulsion layer, wherein the silver halide emulsion layer contains a silver halide emulsion which is spectrally sensitized by adding a spectral sensitizing dye prior to the completion of formation of silver halide particles and at least one kind of pyrazoloazole type magenta coupler represented by the following general formula (I):

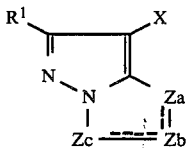

(I)

wherein $R^1$ represents a hydrogen atom or a substituent; X represents a hydrogen atom or a group capable of being released upon a coupling reaction with an oxidation product of an aromatic primary amine developing agent; Za, Zb and Zc each represents a methine group, a substituted methine group, =N— or —NH—, one of the Za—Zb bond and the Zb—Zc bond being a double bond and the other being a single bond, and when the Zb—Zc bond is a carbon-carbon double bond, it may form a part of an aromatic ring; $R^1$ or X may also form a polymer including a dimer or more; and when Za, Zb or Zc is a substituted methine group, the substituted methine group may form a polymer including a dimer or more.

$R_1$ preferably represents a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or an aryloxycarbonyl group; and X preferably represents a hydrogen atom, a halogen atom, a carboxy group or a group capable of being released upon coupling which is bonded to the carbon atom at the coupling position through an oxygen atom, a nitrogen atom or a sulfur atom.

DETAILED DESCRIPTION OF THE INVENTION

The compounds which can be employed in the present invention are described in detail below.

The term "polymer" used in the definition for the general formula (I) means a compound containing at least two groups represented by the general formula (I) in its molecule, and includes a bis coupler and a polymer coupler. The term "polymer coupler" as herein used includes a homopolymer composed of only a monomer having a moiety represented by the general formula (I) (preferably a monomer having a vinyl group, which will be hereinafter referred to as a vinyl monomer), and a copolymer composed of a vinyl monomer described above and a non-color forming ethylenic monomer which does not undergo coupling with the oxidation product of an aromatic primary amine developing agent.

Of the pyrazoloazole type magenta couplers represented by the general formula (I), preferred couplers are those represented by the following general formula (II), (III), (IV) or (V):

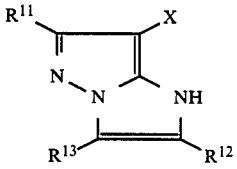

[II]

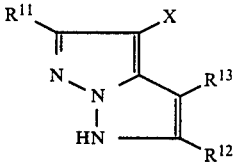

[III]

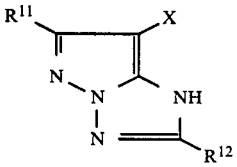

[IV]

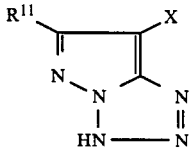

[V]

More preferred couplers are those represented by the general formula (II) and (V) and most preferred couplers are those represented by the general formula (IV).

In the general formula (II), (III), (IV) or (V), $R^{11}$, $R^{12}$ and $R^{13}$, which may be the same or different, each represents a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or an aryloxycarbonyl group which group connects directly or through a linking group; and X represents a hydrogen atom, a halogen atom, a carboxy group or a group capable of being released upon coupling which is bonded to the carbon atom at the coupling position through an oxygen atom, a nitrogen atom or a sulfur atom. Also, $R^{11}$, $R^{12}$, $R^{13}$ or X may be a divalent group to form a bis coupler. Further, the coupler represented by the general formula (II), (III), (IV) or (V) may be in the form of a polymer coupler in which the coupler moiety exists at the main chain or the side chain of the polymer and particularly a polymer coupler derived from a vinyl monomer having the coupler moiety represented by the general formula (II) or (IV) described above is preferred. In this case, $R^{11}$, $R^{12}$, $R^{13}$ or X represents a vinyl group or a linking group.

In more detail, $R^{11}$, $R^{12}$ and $R^{13}$ each represents a hydrogen atom, a halogen atom (e.g., a chlorine atom, a bromine atom, etc.), an alkyl group (e.g., a methyl group, a propyl group, a tert-butyl group, a trifluoromethyl group, a tridecyl group, a 3-(2,4-di-tert-amylphenoxy)propyl group, an allyl group, a 2-dodecyloxyethyl group, a 3-phenoxypropyl group, a 2-hexylsulfonylethyl group, a cyclopentyl group, a benzyl group, etc.), an aryl group (e.g., a phenyl group, a 4-tert-butylphenyl group, a 2,4-di-tert-amylphenyl group, a 4-tetradecanamidophenyl group, etc.), a heterocyclic group (e.g., a 2-furyl group, a 2-thienyl group, a 2-pyrimidinyl group, a 2-benzothiazolyl group, etc.), a cyano group, an alkoxy group (e.g., a methoxy group, an ethoxy group, a 2-methoxyethoxy group, a 2-dodecyloxyethoxy group, a 2-methanesulfonylethoxy group, etc.), an aryloxy group (e.g., a phenoxy group, a 2-methylphenoxy group, a 4-tert-butylphenoxy group, etc.), a heterocyclic oxy group (e.g., a 2-benzimidazolyloxy group, etc.), an acyloxy group (e.g., an acetoxy group, a hexadecanoyloxy group, etc.), a carbamoyloxy group (e.g., an N-phenylcarbamoyloxy group, an N-ethylcarbamoyloxy group, etc.), a silyloxy group (e.g., a trimethylsilyloxy group, etc.), a sulfonyloxy group (e.g., a dodecylsulfonyloxy group, etc.), an acylamino group (e.g., an acetamido group, a benzamido group, a tetradecanamido group, an α-(2,4-di-tert-amylphenoxy)-butylamido group, a γ-(3-tert-butyl-4-hydroxyphenoxy)buty amidolgroup, an α-[4-(4-hydroxyphenylsulfonyl)phenoxy]decanamido group, etc.), an anilino group (e.g., a phenylamino group, a 2-chloroanilino group, a 2-chloro-5-tetradecanamidoanilino group, a 2-chloro-5-dodecyloxycarbonylanilino group, an N-acetylanilino group, a 2-chloro-5-[α-(3-tert-butyl-4-hydroxyphenoxy)dodecanamido]anilino group, etc.), a ureido group (e.g., a phenylureido group, a methylureido group, an N,N-dibutylureido group, etc.), an imido group (e.g., an N-succinimido group, a 3-benzylhydantoinyl group, a 4-(2-ethylhexanoylamino)phthalimido group, etc.), a sulfamoylamino group (e.g., an N,N-dipropylsulfamoylamino group, an N-methyl-N-decylsulfamoylamino group, etc.), an alkylthio group (e.g., a methylthio group, an octylthio group, a tetradecylthio group, a 2-phenoxyethylthio group, a 3-phenoxypropylthio group, a 3-(4-tert-butylphenoxy)propylthio group, etc.), an arylthio group (e.g., a phenylthio group, a 2-butoxy-5-tert-octylphenylthio group, a 3-pentadecylphenylthio group, a 2-carboxyphenylthio group, a 4-tetradecanamidophenylthio group, etc.), a heterocyclic thio group (e.g., a 2-benzothiazolylthio group, etc.), an alkoxycarbonylamino group (e.g., a methoxycarbonylamino group, a tetradecyloxycarbonylamino group, etc.), an aryloxycarbonylamino group (e.g., a phenoxycarbonylamino group, a 2,4-di-tert-butylphenoxycarbonylamino group, etc.), a sulfonamido group (e.g., a methanesulfonamido group, a hexadecanesulfonamido group, a benzensulfonamido group, a p-toluenesulfonamido group, an octadecanesulfonamido group, a 2-methyloxy-5-tert-butylbenzenesulfonamido group, etc.), a carbamoyl group (e.g., an N-ethylcarbamoyl group, an N,N-dibutylcarbamoyl group, an N-(2-dodecyloxyethyl)carbamoyl group, an N-methyl-N-dodecylcarbamoyl group, an N-[3-(2,4-di-tert-amylphenoxy)propyl]carbamoyl group, etc.), an acyl group (e.g., an acetyl group, a (2,4-di-tert-amylphenoxy)acetyl group, a benzoyl group, etc.), a sulfamoyl group (e.g., an N-ethylsulfamoyl group, an N,N-dipropylsulfamoyl group, an N-(2-dodecyloxyethyl)sulfamoyl group, an N-ethyl-N-dodecylsulfamoyl group, an N,N-diethylsulfamoyl group, etc.), a sulfonyl group (e.g., a methanesulfonyl group, an octanesulfonyl group, a benzenesulfonyl group, a toluenesulfonyl group, etc.), a sulfinyl group (e.g., an octanesulfinyl group, a dodecylsulfinyl group, a phenylsulfinyl group, etc.), an alkoxycarbonyl group (e.g., a methoxycarbonyl group, a butyloxycarbonyl group, a dodecylcarbonyl group, an octadecylcarbonyl group, etc.) or an aryloxycarbonyl group (e.g., a phenyloxycarbonyl group, a 3-pentadecyloxycarbonyl group, etc.); and X represents a hydrogen atom; a halogen atom (e.g., a chlorine atom, a bromine atom, an iodine atom, etc.); a carboxy group; a group bonded to the coupling position through an oxygen atom (e.g., an acetoxy group, a propanoyloxy group, a benzoyloxy group, a 2,4-dichlorobenzoyloxy group, an ethoxyoxaloyloxy group, a pyruvinyloxy group, a cinnamoyloxy group, a phenoxy group, a 4-cyanophenoxy group, a 4-methanesulfonamidophenoxy group, a 4-methanesulfonylphenoxy group, an α-naphthoxy group, a 3-pentadecylphenoxy group, a benzyloxycarbonyloxy group, an ethoxy group, a 2-cyanoethoxy group, a benzyloxy group, a 2-phenethyloxy group, a 2-phenoxyethoxy group, a 5-phenyltetrazolyloxy group, a 2-benzothiazolyloxy group, etc.); a group bonded to the coupling position through a nitrogen atom (e.g., a benzenesulfonamido group, an N-ethyltoluenesulfonamido group, a heptafluorobutanamido group, a 2,3,4,5,6-pentafluorobenzamido group, an octanesulfonamido group, a p-cyanophenylureido group, an N,N-diethylsulfamoylamino group, a 1-piperidyl group, a 5,5-dimethyl-2,4-dioxo-3-oxazolidinyl group, a 1-benzyl-5-ethoxy-3-hydantoinyl group, a 2N-1,1-dioxo-3(2H)-oxo-1,2-benzisothiazolyl group, a 2-oxo-1,2-dihydro-1-pyridinyl group, an imidazolyl group, a pyrazolyl group, a 3,5-diethyl-1,2,4-triazol-1-yl group, a 5- or 6-bromobenzotriazol-1-yl group, a 5-methyl-1,2,3,4-triazol-1-yl group, a benzimidazolyl group, a 3-benzyl-1-hydantoinyl group, a 1-benzyl-5-hexadecyloxy-3-hydantoinyl group, a 5-methyl-1-tetrazolyl group, an arylazo group (e.g., a 4-methoxyphenylazo group, a 4-pivaloylaminophenylazo group, a 2-naphthylazo group, a 3-methyl-4-hydroxyphenylazo group, etc.)); or a group bonded to the coupling position through a sulfur atom (e.g., a phenylthio group, a 2-carboxyphenylthio group, a 2-methoxy-5-tert-octylphenylthio group, 4-methanesulfonylphenylthio group, a 4-octanesulfonamidophenylthio group, a 2-butoxyphenylthio group, a 2-(2-hexanesulfonylethyl)-5-tert-octylphenylthio group, a benzylthio group, a 2-cyanoethylthio group, a 1-ethoxycarbonyltridecylthio group, a 5-phenyl-2,3,4,5-tetrazolylthio group, a 2-benzothiazolylthio group, a 2-dodecylthio-5-thiophenylthio group, a 2-phenyl-3-dodecyl-1,2,4-triazolyl-5-thio group, etc.).

In the coupler represented by the general formula (II) or (III), $R^{12}$ and $R^{13}$ may combine with each other to form a 5-membered, 6-membered or 7-membered ring.

When $R^{11}$, $R^{12}$ or $R^{13}$ contains a linking group, the linking group preferably represents a substituted or unsubstituted alkylene group (e.g., a methylene group, an ethylene group, a 1,10-decylene group, $—CH_2CH_2—O—CH_2CH_2—$, etc.), a substituted or unsubstituted phenylene group (e.g., a 1,4-phenylene group, a 1,3-phenylene group

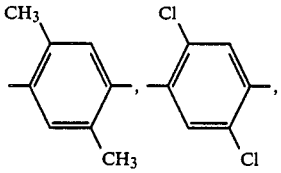

etc.), an —NHCO—$R^{14}$—CONH— group (wherein $R^{14}$ represents a substituted or unsubstituted alkylene or phenylene group, e.g.,

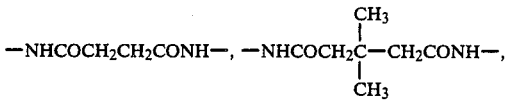

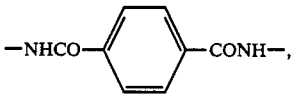

etc.), a —$NR^{15}CONR^{15}$— group (wherein $R^{15}$ represents an alkyl group having 1 to 5 carbon aomts), an —S—$R^{16}$—S— group (wherein $R^{16}$ represents a substituted or unsubstituted alkylene group, e.g., —S—$CH_2CH_2$—S—,

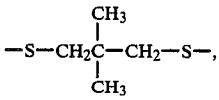

etc.), a —$NHSO_2$— group or a —$SO_2NH$— group.

When $R^{11}$, $R^{12}$, $R^{13}$ or X represents a divalent group to form a bis coupler, $R^{11}$, $R^{12}$ or $R^{13}$ preferably represents a substituted or unsubstituted alkylene group (e.g., a methylene group, an ethylene group, a 1,10-decylene group, —$CH_2CH_2$—O—$CH_2CH_2$—, etc.), a substituted or unsubstituted phenylene group (e.g., a 1,4-phenylene group, a 1,3-phenylene group,

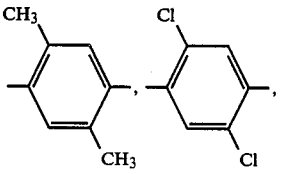

etc.), an —NHCO—$R^{14}$—CONH— group (wherein $R^{14}$ represents a substituted or unsubstituted alkylene or phenylene group, e.g.,

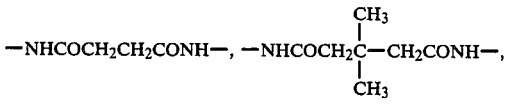

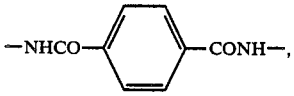

etc.) or an —S—$R^{16}$—S— group (wherein $R^{16}$ represents a substituted or unsubstituted alkylene group, e.g., —S—$CH_2CH_2$—S—,

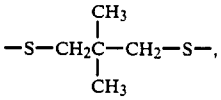

etc.); and X represents a divalent group appropriately formed from the monovalent group for X described above.

The group represented by $R^{11}$, $R^{12}$, $R^{13}$ or X in the case wherein the coupler moiety represented by the general formula (II), (III), (IV) or (V) is included in a vinyl monomer includes an alkylene group (including a substituted or unsubstituted alkylene group, e.g., a methylene group, an ethylene group, a 1,10-decylene group, —$CH_2CH_2OCH_2CH_2$—, etc.), a phenylene group (including a substituted or unsubstituted phenylene group, e.g., a 1,4-phenylene group, a 1,3-phenylene group,

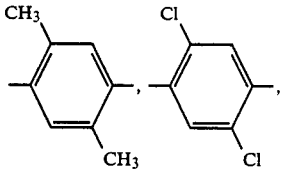

etc.), a —NHCO—, —CONH—, —O—, —OCO—, and an aralkylene group (e.g.,

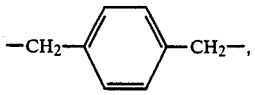

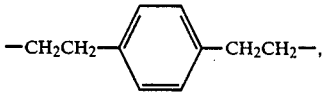

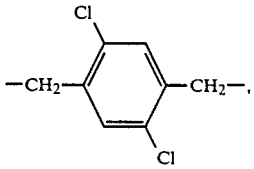

etc.) or a combination thereof.

Specific examples of preferred linking groups are set forth below.

—NHCO—, —$CH_2CH_2$—,

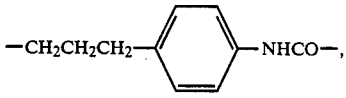

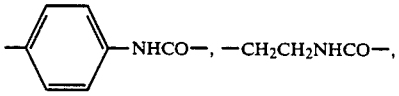

—$CH_2CH_2$—O—C(=O)—, —CONH—$CH_2CH_2$—NHCO—,

-continued $-CH_2CH_2OCH_2CH_2-NHCO-$

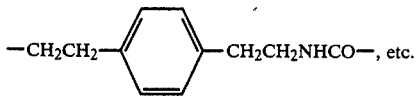

Further, a vinyl group in the vinyl monomer may further have a substituent in addition to the coupler moiety represented by the general formula (II), (III), (IV) or (V). Preferred examples of the substituents include a hydrogen atom, a chlorine atom or a lower alkyl group having from 1 to 4 carbon atoms (e.g., a methyl group, an ethyl group, etc.).

Among the couplers represented by the general formula (II), (III), (IV) or (V), the couplers represented by the general formula (II) or (IV) are preferred. Further, the couplers represented by the general formula (IV) are particularly preferred.

A monomer containing the coupler moiety represented by the general formula (II), (III), (IV) or (V) may form a copolymer together with a non-color forming ethylenic monomer which does not undergo coupling with the oxidation product of an aromatic primary amine developing agent.

Examples of non-color forming ethylenic monomers which do not undergo coupling with the oxidation product of an aromatic primary amine developing agent include acrylic acid and derivatives thereof such as acrylic acid, α-chloroacrylic acid, α-alkylacrylic acid (e.g., methacrylic acid, etc.), etc., an ester or an amide derived from these acrylic acids (e.g., acrylamide, n-butylacrylamide, tert-butylacrylamide, diacetoneacrylamide, methacrylamide, methyl acrylate, ethyl acrylate, n-propyl acrylate, n-butyl acrylate, tertbutyl acrylate, isobutyl acrylate, 2-ethylhexyl acrylate, n-octyl acrylate, lauryl acrylate, methyl methacrylate, ethyl methacrylate, n-butyl methacrylate, β-hydroxy methacrylate, etc.), methylenedibisacrylamide, a vinyl ester (e.g., vinyl acetate, vinyl propionate, vinyl laurate, etc.), acrylonitrile, methacrylonitrile, an aromatic vinyl compound (e.g., styrene and derivatives thereof, vinyltoluene, divinylbenzene, vinylacetophenone, sulfostyrene, etc.), itaconic acid, citraconic acid, crotonic acid, vinylidene chloride, a vinyl alkyl ether (e.g., vinyl ethyl ether, etc.), maleic acid, maleic anhydride, a maleic acid ester, N-vinyl-2-pyrrolidone, N-vinylpyridine, 2- or 4-vinylpyridine, etc.

Two or more kinds of the non-color forming ethylenically unsaturated monomers can be used together. For example, a combination of n-butyl acrylate and methyl acrylate, styrene and methacrylic acid, methacrylic acid and acrylamide, methyl acrylate and diacetoneacrylamide, etc., can be used.

As is well known in the field of polymer color couplers, the non-color forming ethylenically unsaturated monomer which is copolymerized with a solid water-insoluble monomer coupler can be selected in such a manner that the copolymer formed has good physical properties and/or chemical properties, for example, solubility, compatibility with a binder in a photographic colloid composition, such as gelatin, flexibility, heat stability, etc.

The polymer couplers used in the present invention may be water-soluble coupler or water-insoluble couplers, but polymer coupler latexes are particularly preferred as such polymer couplers.

Specific examples of the pyrazoloazole type magenta couplers represented by the general formula (I) which can be used in the present invention and methods for preparation thereof are described, for example, in Japanese Patent Application (OPI) No. 162548/84, Japanese Patent Application Nos. 151354/83, and 27411/72. (The term "OPI" as used herein refers to a "published unexamined Japanese patent application.)

Specific examples of representative magenta couplers and vinyl monomers for preparing polymer couplers according to the present invention are set forth below, but the present invention should not be construed as being limited thereto.

(M-1)

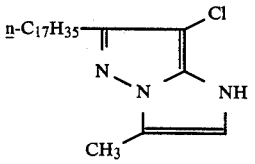

(M-2)

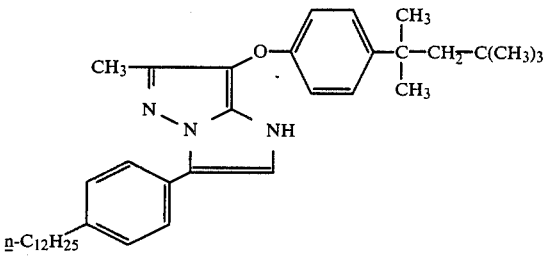

(M-3)

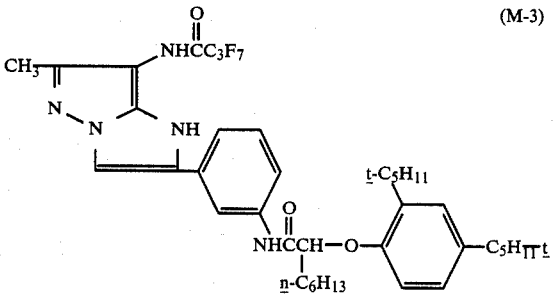

(M-4)

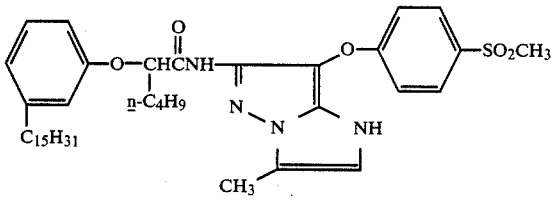

-continued
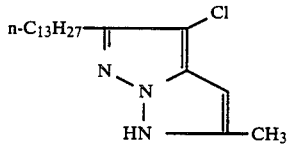
(M-5)
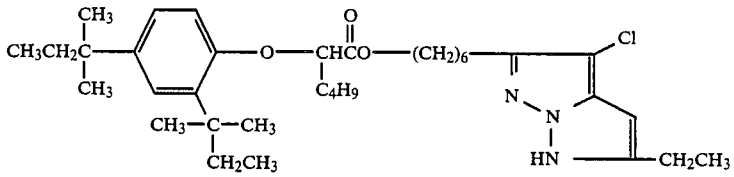
(M-6)
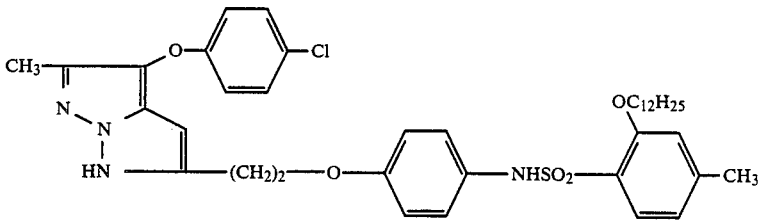
(M-7)
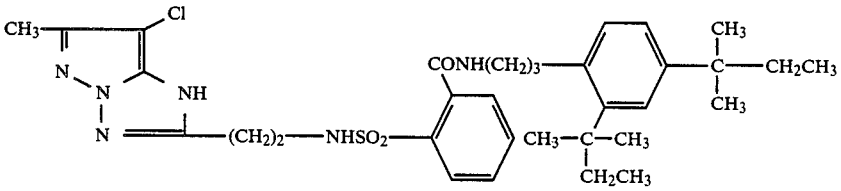
(M-8)
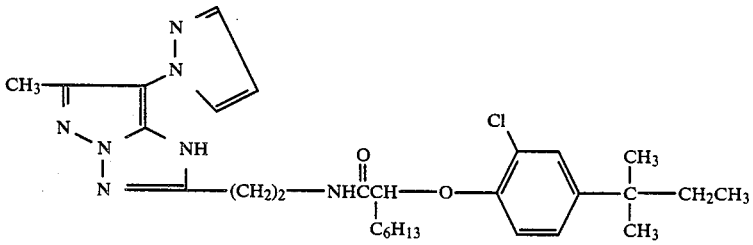
(M-9)
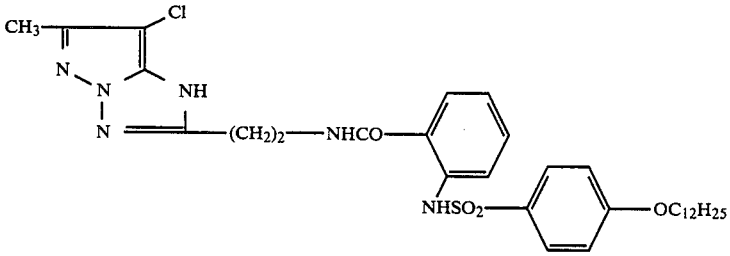
(M-10)
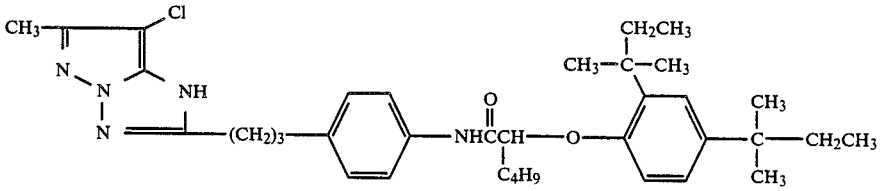
(M-11)

-continued
(M-12)
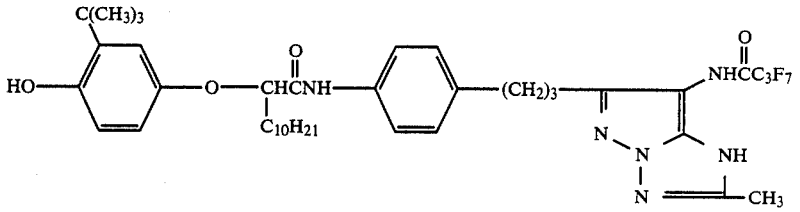
(M-13)
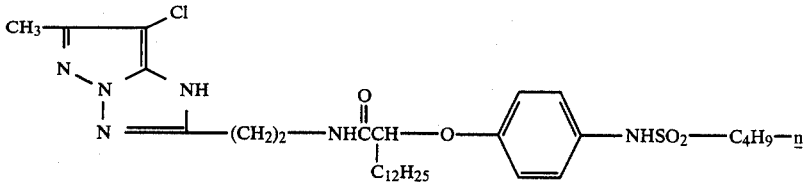
(M-14)
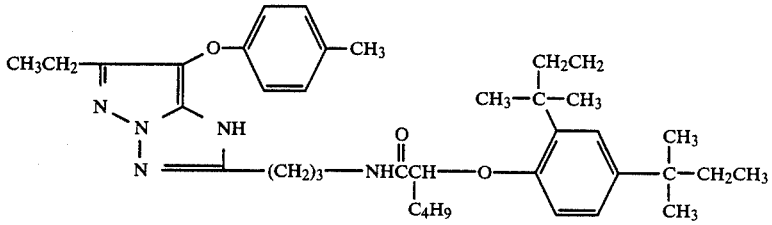
(M-15)
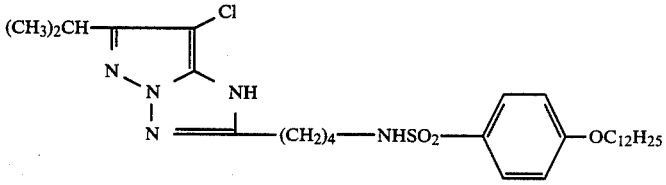
(M-16)
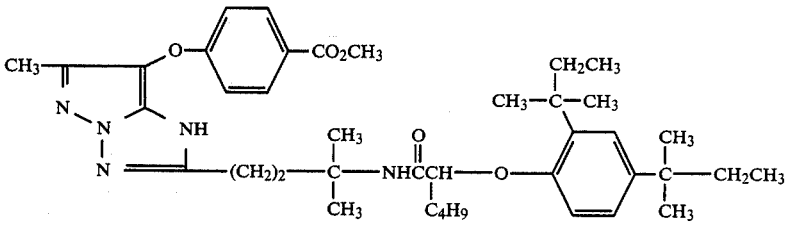
(M-17)
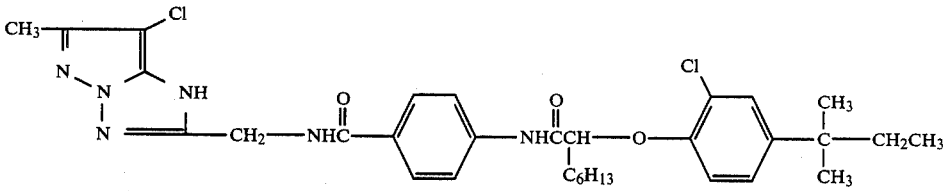
(M-18)
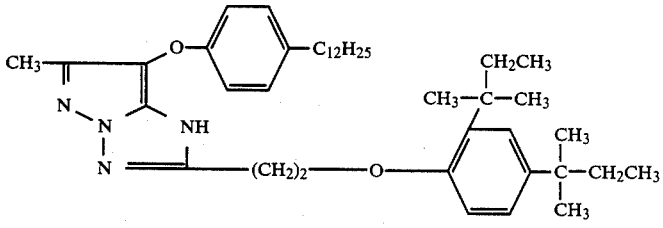

-continued
(M-19)
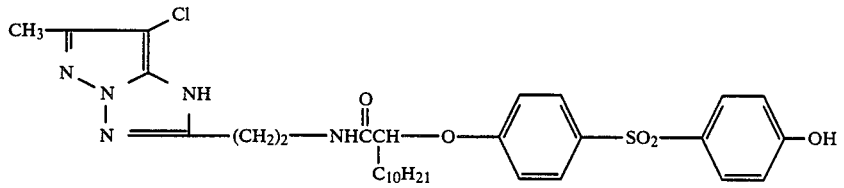
(M-20)
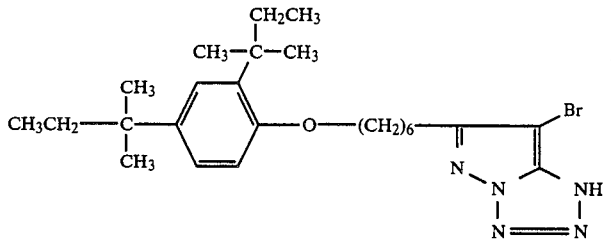
(M-21)
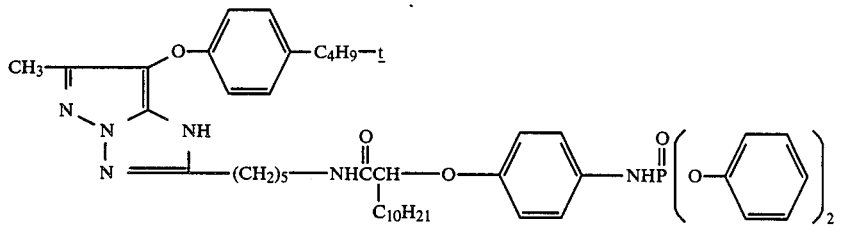
(M-22)
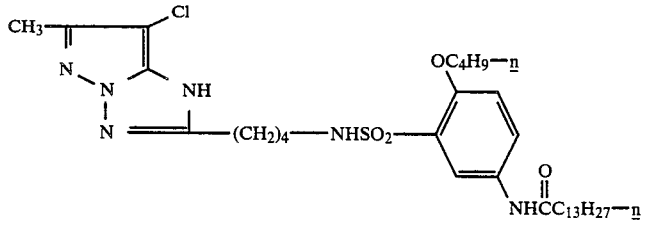
(M-23)
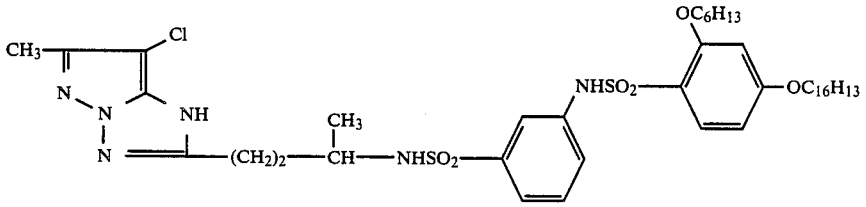
(M-24)
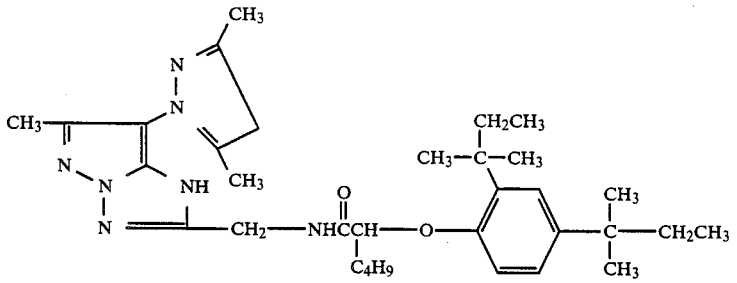
(M-25)
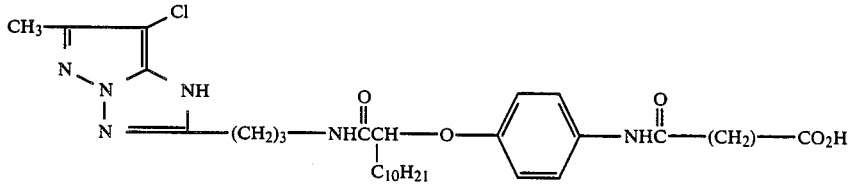

-continued
(M-26)
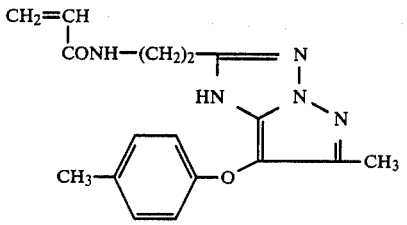
(M-27)
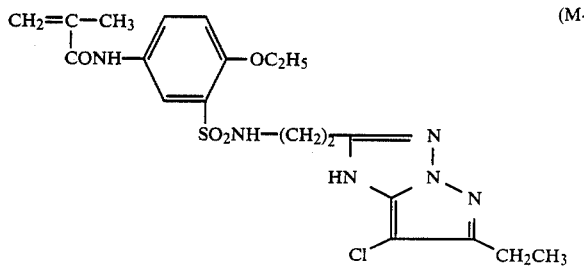
(M-28)
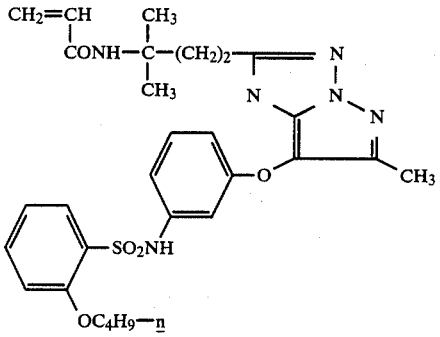
(M-29)
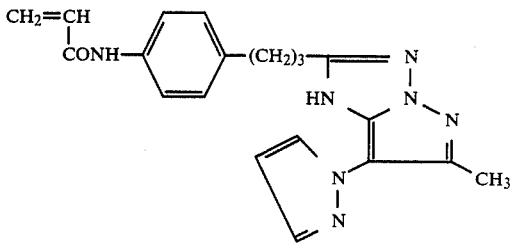
(M-30)
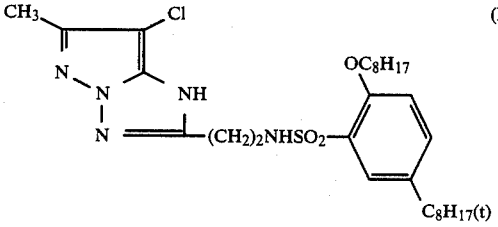
(M-31)
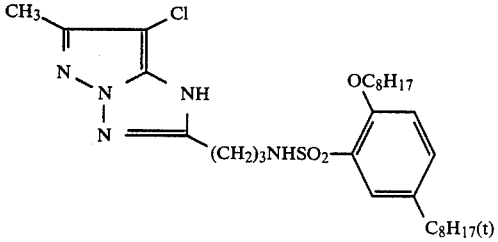
(M-32)
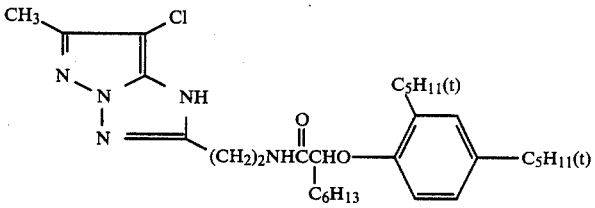
(M-33)
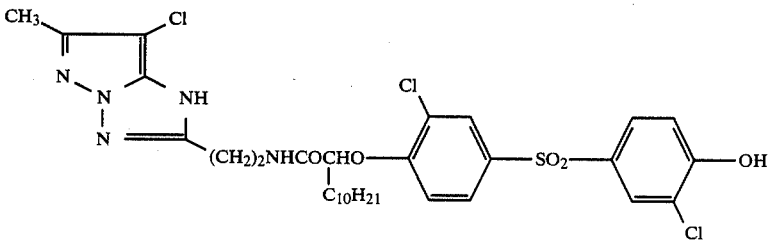
(M-34)
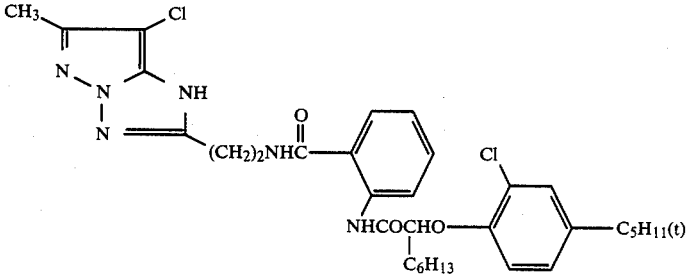

-continued
(M-35)
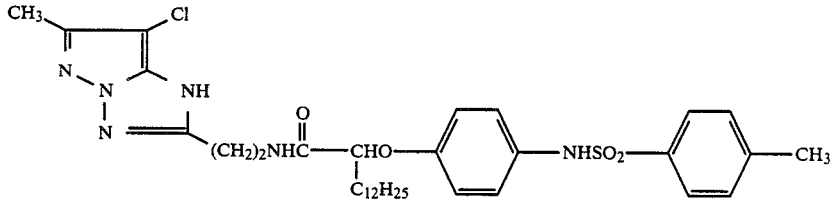
(M-36)
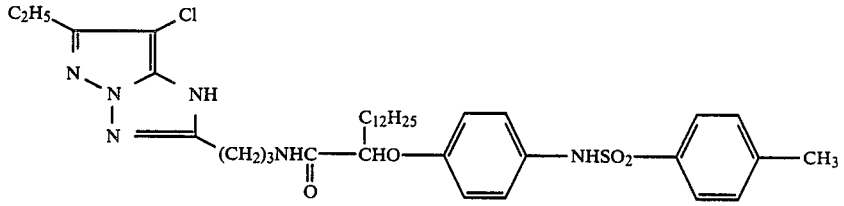
(M-37)
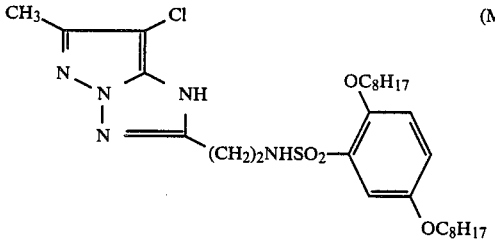
(M-38)
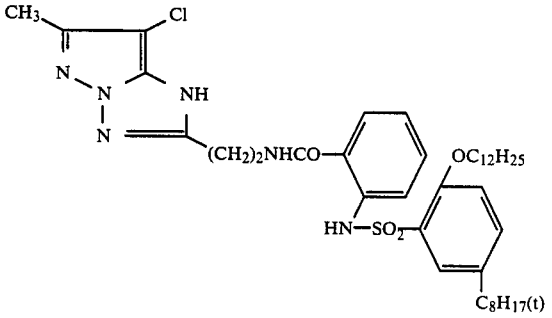
(M-39)
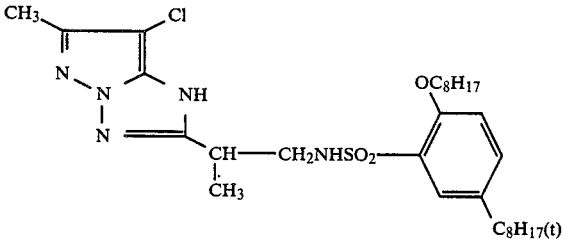
(M-40)
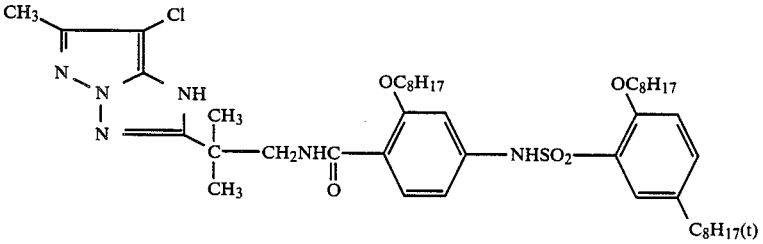
(M-41)
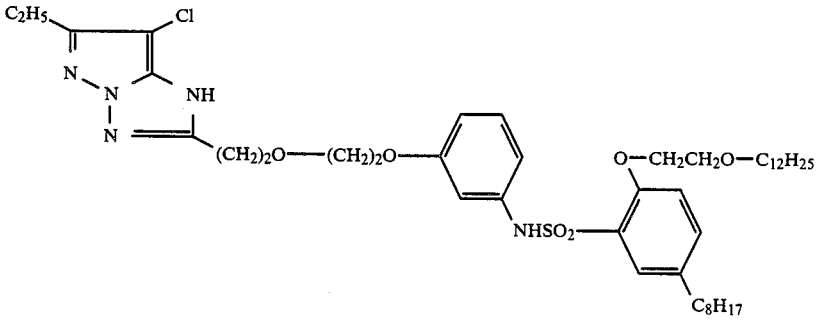

-continued
(M-42)
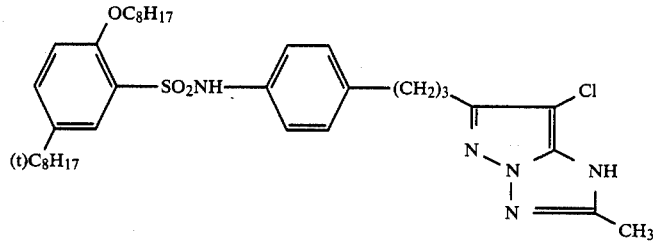
(M-43)
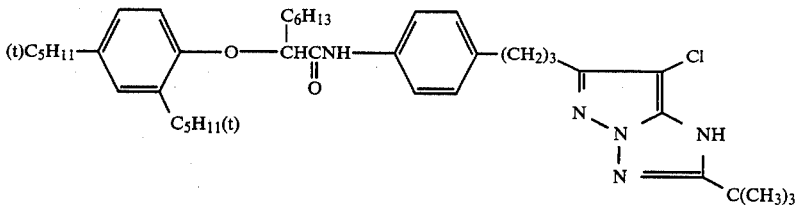
(M-44)
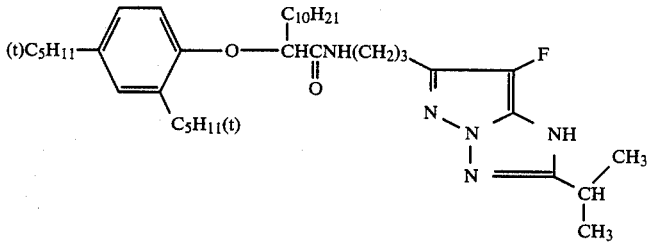
(M-45)
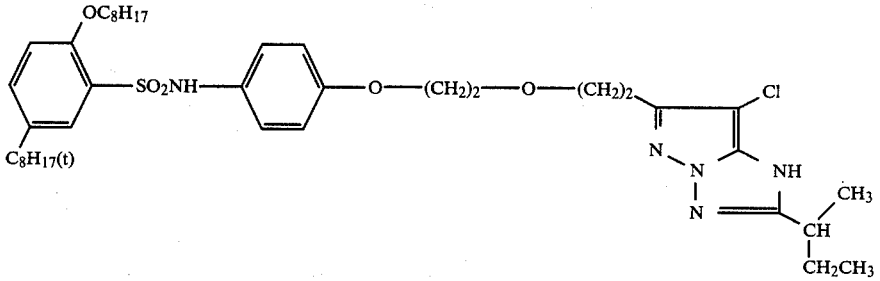
(M-46)
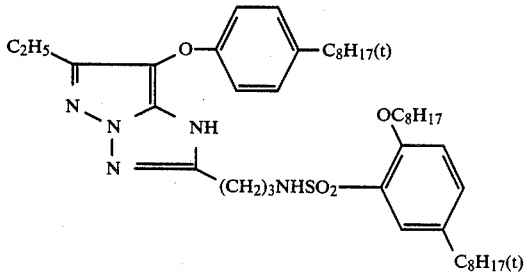
(M-47)
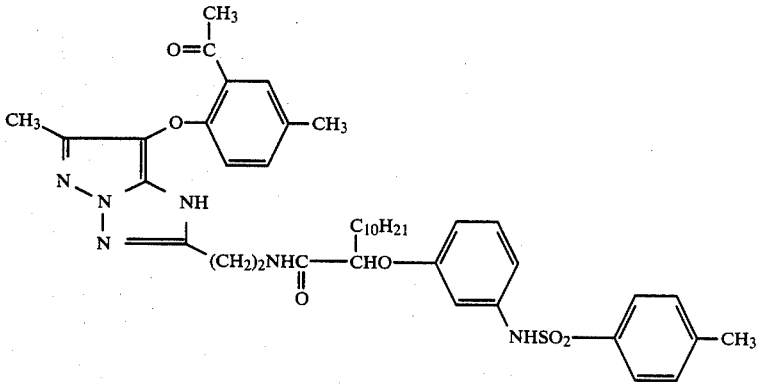

-continued
(M-48)
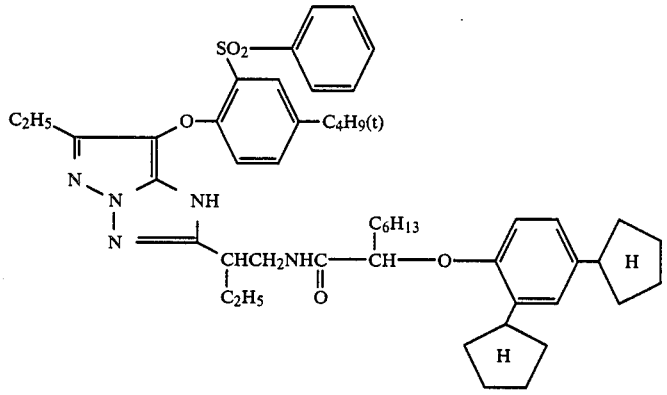
(M-49)
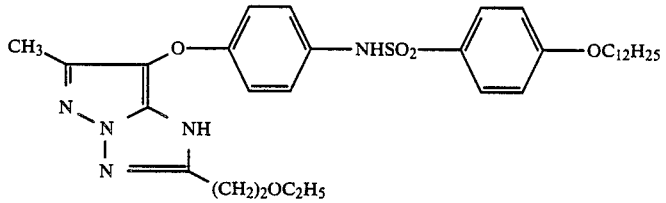
(M-50)
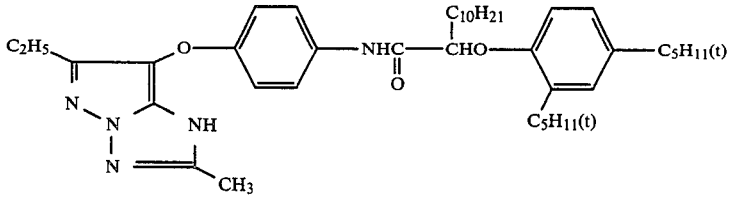
(M-51)
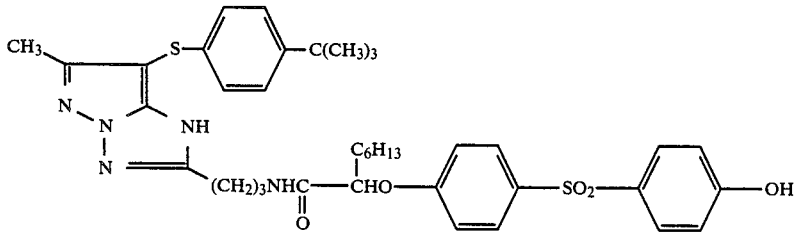
(M-52)
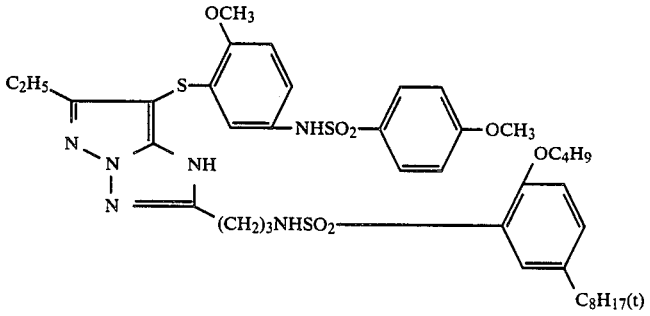

-continued
(M-53)
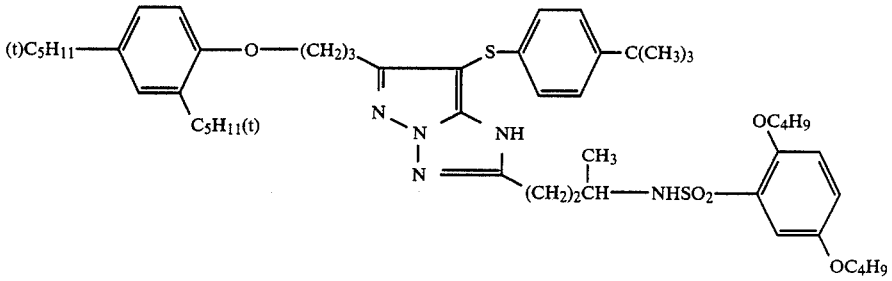
(M-54)
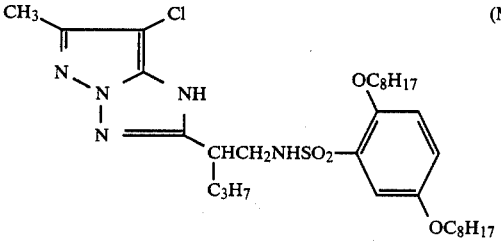
(M-55)
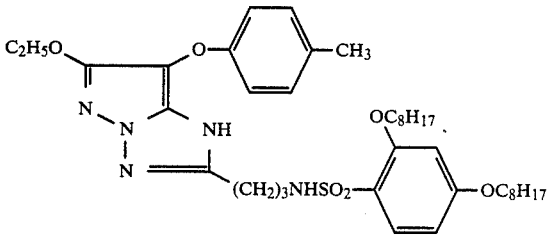
(M-56)
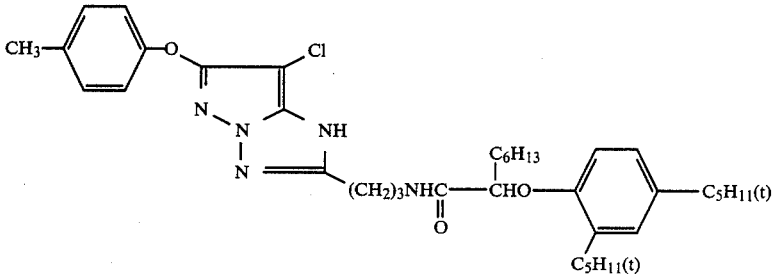
(M-57)
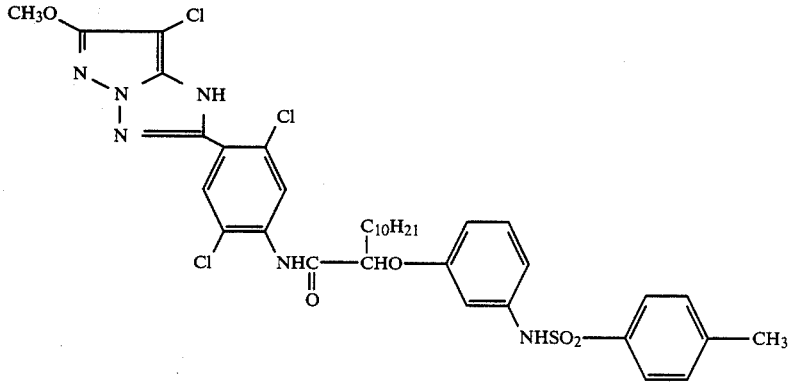
(M-58)
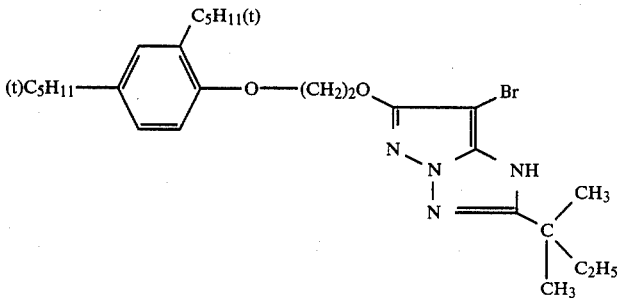

-continued
(M-59)
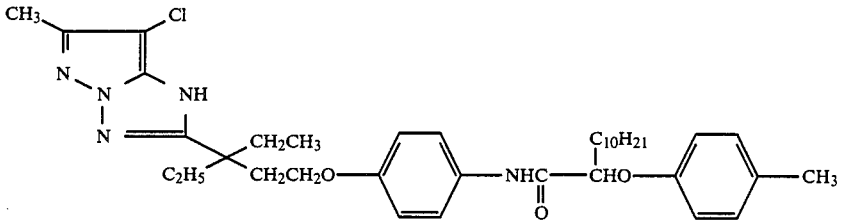
(M-60)
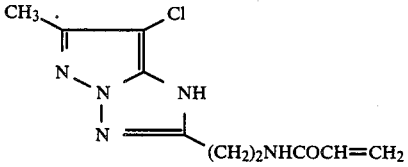
(M-61)
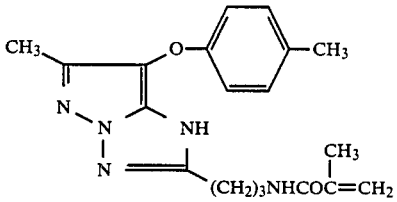
(M-62)
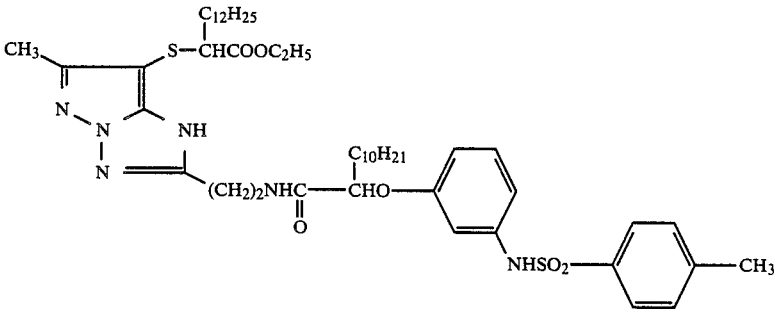
(M-63)
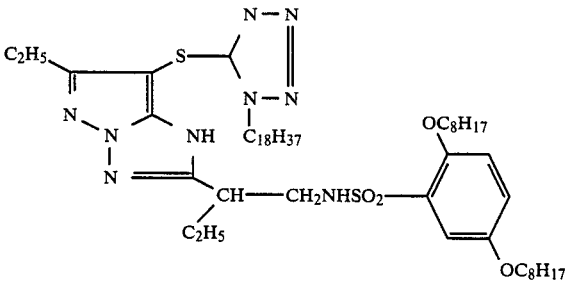
(M-64)
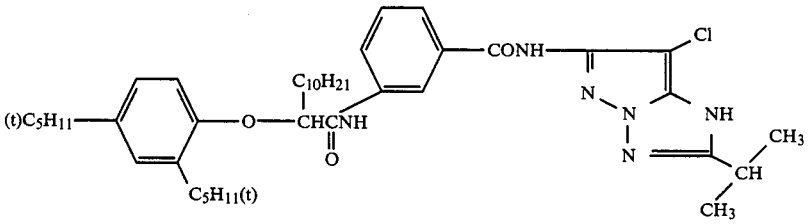
(M-65)
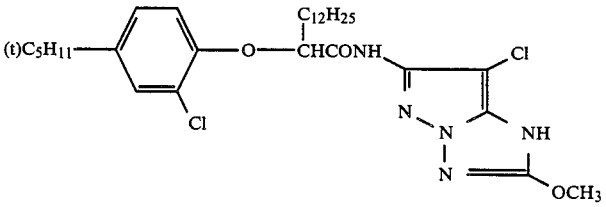

-continued
(M-66)
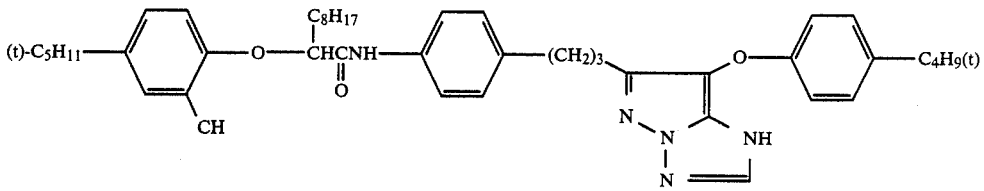
(M-67)
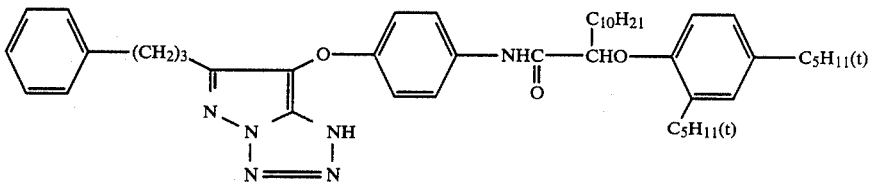
(M-68)
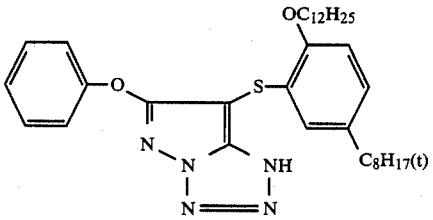
(M-69)
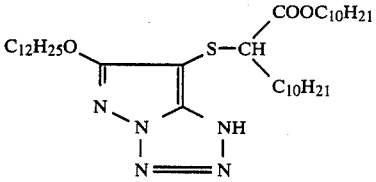
(M-70)
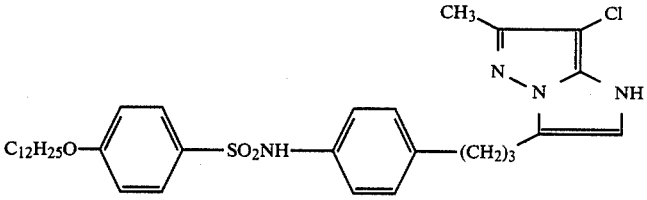
(M-71)
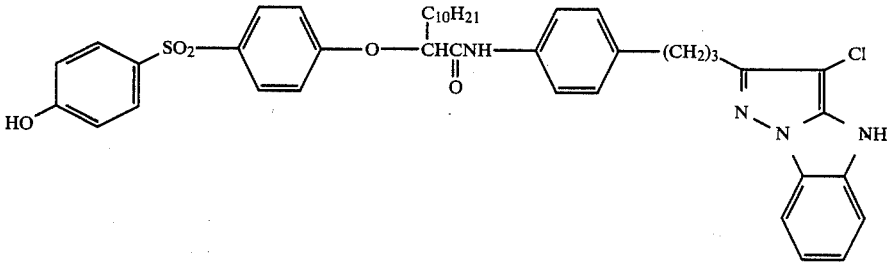
(M-72)
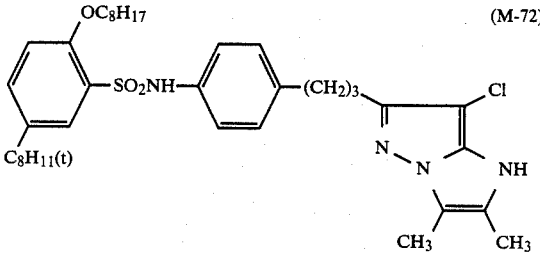
(M-73)
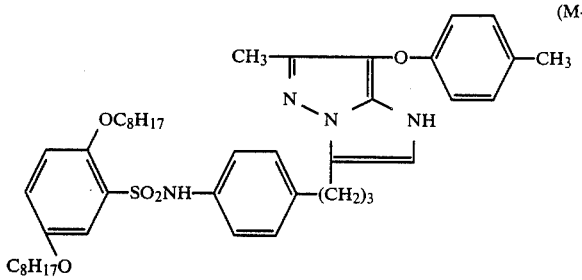
(M-74)
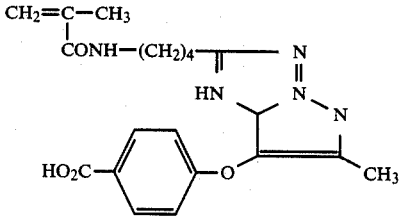
(M-75)
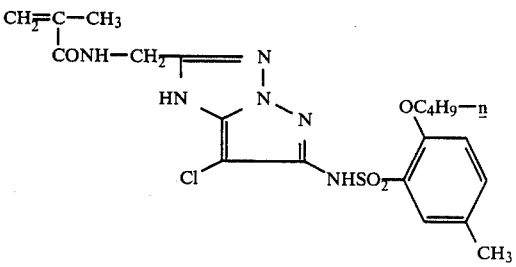

-continued

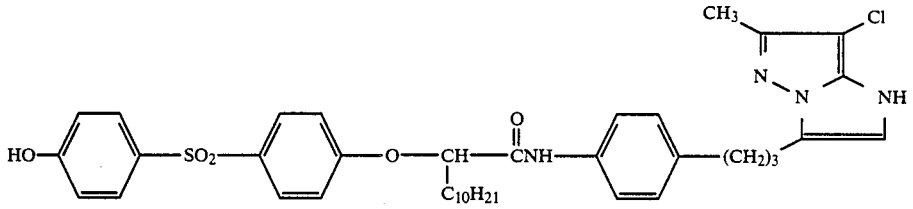
(M-76)

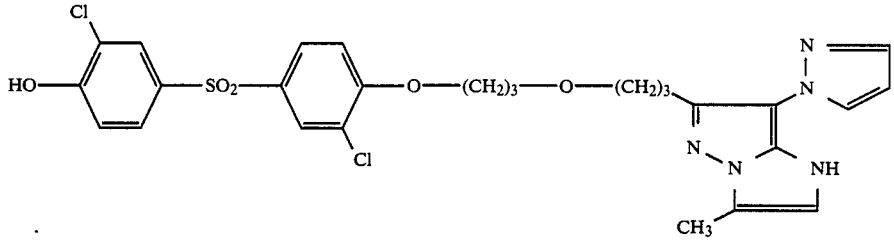
(M-77)

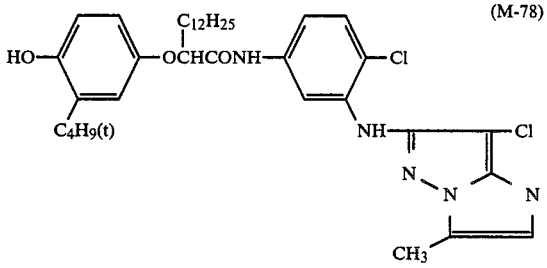
(M-78)

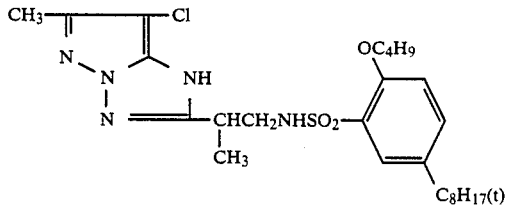
(M-79)

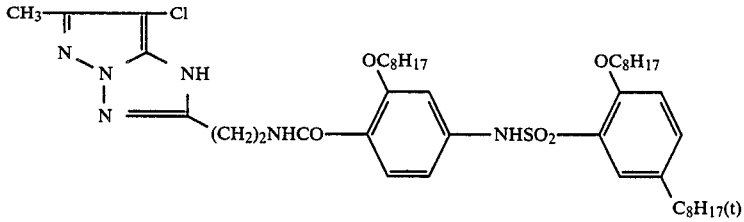
(M-80)

The couplers represented by the general formula (I) according to the present invention can be synthesized according to the methods as described in the following literatures, etc.

The compounds represented by the general formula (II) or (IV) are described in Japanese Patent Application (OPI) No. 162548/84, etc., the compounds represented by the general formula (III) are described in Japanese Patent Application No. 151354/83, etc., the compounds represented by the general formula (V) are described in Japanese Patent Publication No. 27411/72, etc.

The couplers represented by the general formula (I) according to the present invention are incorporated into a silver halide emulsion layer in an amount of from $1\times10^{-3}$ to $5\times10^{-1}$ mol, and preferably from $1\times10^{-2}$ to $5\times10^{-1}$ mol, per mol of silver halide present in the layer. Further, two or more kinds of the couplers according to the present invention may be incorporated into the same emulsion layer.

In order to incorporate the couplers represented by the general formula (I) and other couplers which can be used together therewith as described hereinafter into a silver halide emulsion layer according to the present invention, known methods, including those described, for example, in U.S. Pat. No. 2,322,027 can be used. For example, the couplers can be dissolved in a solvent and then dispersed in a hydrophilic colloid. Examples of solvents usable for this process include organic solvents having a high boiling point, such as alkyl esters of phthalic acid (e.g., dibutyl phthalate, dioctyl phthalate, etc.), phosphates (e.g., tri-2-ethylhexyl)phosphate, triphenyl phosphate, tricresyl phosphate dioctyl butyl phosphate, etc.), citrates (e.g., tributyl acetyl citrate, etc.), benzoates (e.g., octyl benzoate, etc.), alkylamides (e.g., diethyl laurylamides, etc.), esters of fatty acids (e.g., dibutoxyethyl succinate, diethyl azelate, etc.), trimesates (e.g., tributyl trimesate, etc.), or the like; and organic solvents having a boiling point of from about 30° to about 150° C., such as lower alkyl acetates (e.g., ethyl acetate, butyl acetate, etc.), ethyl propionate, secondary butyl alcohol, methyl isobutyl ketone, β-ethoxyethyl acetate, methyl cellosolve acetate, or the like. Mixtures of the above described organic solvents having a high boiling point and the above described organic solvents having a low boiling point can also be used.

It is also possible to utilize the dispersing method using polymers as described in Japanese Patent Publication No. 39853/76 and Japanese Patent Application (OPI) No. 59943/76.

Of the couplers, those having an acid group, such as a carboxylic acid group or a sulfonic acid group, etc.

can be introduced into hydrophilic colloids as an aqueous alkaline solution.

According to the present invention, the sensitizing dyes can be added to a silver halide emulsion at any time before the completion of formation of silver halide grains. An appropriate time of addition can be selected depending on kinds of sensitizing dyes and silver halide emulsions used. The total amount of sensitizing dye to be employed may be added to the reaction solution simultaneously with or before start of the formation of silver halide grains or at an appropriate time during the formation of silver halide grains. According to a preferred addition method in the latter case, the sensitizing dye is added after the formation of 85% or more, preferably 90% or more and more preferably 95% or more of the total weight of silver halide grains.

Further, the total amount of sensitizing dye to be employed may be added at several times in portions. As an example of such a case, divided portions of the sensitizing dye may be added at a suitable time interval from the beginning of formation of silver halide grains in a process of the formation of silver halide grains. Moreover, the sensitizing dye may be continuously added to the reaction solution before the completion of the silver halide grain-forming process (it may be added individually or together with a silver nitrate solution, a halogenide solution, etc.). In this case, the addition of sensitizing dye can be initiated simultaneously with or before start of the formation of silver halide grains or after start of the formation of silver halide grains. Furthermore, in a preparation method of emulsion wherein crystals are allowed to grow up, the sensitizing dye may be added continuously or intermittently during the silver halide grain-growing process.

The sensitizing dyes to be used in the present invention can be directly dispersed in an emulsion. Alternatively, they may be first dissolved in a suitable solvent such as methyl alcohol, ethyl alcohol, n-propanol, methyl cellosolve, acetone, water, pyridine, or a mixture thereof to add them to an emulsion as a solution. Ultrasonic wave can be applied to the dissolving step. Further, as a process for adding the sensitizing dye to an emulsion, there is employed a process of dissolving the dye in a volatile organic solvent, dispersing the resulting solution in a hydrophilic colloid, and adding this dispersion to a photographic emulsion as described in U.S. Pat. No. 3,469,987; a process of dispersing a water-insoluble dye in an aqueous solution without dissolution, and adding the resulting dispersion to a photographic emulsion as described in Japanese Patent Publication No. 24185/71; a process of dissolving the dye in a surface active agent and adding the resulting solution to a photographic emulsion as described in U.S. Pat. No. 3,822,135; a process of dissolving the dye using a compound capable of effecting a red shift, and adding the resulting solution to a photographic emulsion as described in Japanese Patent Application (OPI) No. 74624/76; or a process of dissolving the dye in a substantially water-free acid, and adding the resulting solution to a photographic emulsion as described in Japanese Patent Application (OPI) No. 80826/75. In addition, those processes which are described in U.S. Pat. Nos. 2,912,343, 3,342,605, 2,996,287 and 3,429,835, etc., can be employed for adding the dye to a photographic emulsion.

Suitable dyes which can be employed in the present invention include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes and complex merocyanine dyes are particularly useful.

Any conventionally utilized nuclei for cyanine dyes are applicable to these dyes as basic heterocyclic nuclei. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, or a pyridine nucleus, etc., and further, nuclei formed by condensing alicyclic hydrocarbon rings with these nuclei and nuclei formed by condensing aromatic hydrocarbon rings with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, or a quinoline nucleus, etc., are appropriate. The carbon atoms of these nuclei can also be substituted.

The merocyanine dyes and the complex merocyanine dyes that can be employed contain 5-membered or 6-membered heterocyclic nuclei such as a pyrazolin-5-one nucleus, a thiohydantoin nucleus, a 2-thioxazolidin-2,4-dione nucleus, a thiazolidine-2,4-dione nucleus, a rhodanine nucleus, a thiobarbituric acid nucleus, and the like, as a nucleus having a ketomethylene structure.

The sensitizing dyes which are particularly suitable to the present invention are those represented by the following general formula (A), (B) or (C):

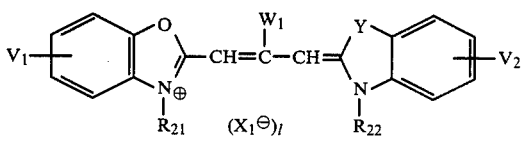

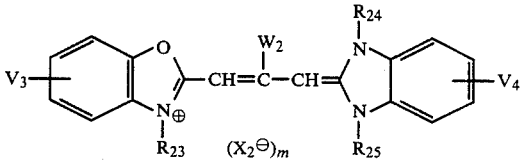

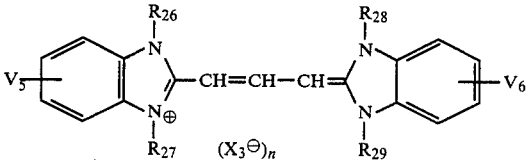

wherein $W_1$ and $W_2$ each represents a hydrogen atom or an alkyl group; $V_1$, $V_2$, $V_3$ and $V_4$, which may be the same or different, each represents a hydrogen atom, a halogen atom, an alkyl group, an aryl group, an alkoxy group, an amido group, an alkoxycarbonyl group, a cyano group, or a condensed benzene ring; $V_5$ and $V_6$, which may be the same or different, each represents a hydrogen atom, a halogen atom, an alkyl group, an alkoxy group, an amido group, an alkoxycarbonyl group or a cyano group; two or more of the substituents represented by $V_1$, $V_2$, $V_3$, $V_4$, $V_5$ or $V_6$ may be present in the molecules; $R_{21}$, $R_{22}$, $R_{23}$, $R_{24}$, $R_{25}$, $R_{26}$, $R_{27}$, $R_{28}$ and $R_{29}$, which may be the same or different, each represents an alkyl group or an aralkyl group, provided that at least one of $R_{21}$ and $R_{22}$, $R_{23}$, $R_{24}$ and $R_{25}$ or $R_{26}$, $R_{27}$, $R_{28}$ and $R_{29}$ represents an alkyl or aralkyl group having a sulfo group, a salt thereof, a carboxy group, a salt thereof or a hydroxy group; Y represents an oxygen atom or a sulfur atom; $X_1$, $X_2$ and $X_3$ each represents an acid anion; and l, m and n each represents 0 or 1, when the compound is an inner salt, l, m or n is 0.

In the following, the sensitizing dyes represented by the general formula (A), (B) or (C) are described in greater detail.

In the above described general formulae, $W_1$ and $W_2$ each represents a hydrogen atom or an alkyl group (preferably having from 1 to 6 carbon atoms, for example, a methyl group, an ethyl group, a propyl group, a butyl group, etc.). $W_1$ is preferably an ethyl group or a propyl group and $W_2$ is preferably a hydrogen atom.

$V_1$, $V_2$, $V_3$ and $V_4$ each represents a hydrogen atom, a halogen atom (for example, a chlorine atom, a bromine atom, etc.), an alkyl group (preferably having from 1 to 8 carbon atoms, for example, a methyl group, an ethyl group, a propyl group, a butyl group, etc.), an aryl group (for example, a phenyl group, etc.), an alkoxy group (preferably having from 1 to 8 carbon atoms, for example, a methoxy group, an ethoxy group, a propoxy group, etc.), an amido group (preferably having from 2 to 8 carbon atoms, for example, an acetamido group, a propionamido group, a benzamido group, etc.), an alkoxycarbonyl group (preferably having from 2 to 8 carbon atoms, for example, a methoxycarbonyl group, an ethoxycarbonyl group, etc.), or a cyano group. $V_1$ and $V_2$ or $V_3$ and $V_4$ may be the same or different. $V_1$, $V_2$, $V_3$ and $V_4$ each may represent a condensed benzene ring.

$V_5$ and $V_6$, which may be the same or different, each represents a group as defined for $V_1$, $V_2$, $V_3$ or $V_4$ except an aryl group and a condensed benzene ring.

Two or more of the substituents represented by $V_1$, $V_2$, $V_3$, $V_4$, $V_5$ or $V_6$ may be present in the same molecule.

Preferred examples of $V_1$, $V_2$, $V_3$, $V_4$, $V_5$ or $V_6$ are set forth below.

When Y represents an oxygen atom, $V_1$ preferably represents a phenyl group or a condensed benzene ring, and $V_2$ preferably represents a phenyl group, a condensed benzene ring, a chlorine atom or an alkoxy group.

When Y represents a sulfur atom, $V_2$ preferably represents a hydrogen atom, a halogen atom, an alkyl group, a phenyl group, an alkoxy group or an amido group.

$V_3$ and $V_5$ preferably each represents a phenyl group, a chlorine atom or a condensed benzene ring. $V_4$ and $V_6$ preferably each represents a trifluoromethyl group, a chlorine atom, an alkoxycarbonyl group or a cyano group. Further, it is preferred that in the general formula (C), each of the two benzotriazole rings has one chlorine atom or one of the two benzotriazole rings has two chlorine atoms.

$R_{21}$, $R_{22}$, $R_{23}$, $R_{24}$, $R_{25}$, $R_{26}$, $R_{27}$, $R_{28}$ and $R_{29}$ each represents an alkyl group (preferably having 1 to 8 carbon atoms, for example, a methyl group, an ethyl group, a propyl group, a butyl group, etc. and which may be a branched chain or a cyclic form, for example, an isopropyl group, a cyclohexyl group, etc.) or an aralkyl group (for example, a benzyl group, a phenethyl group, etc.). Preferably, $R_{21}$ to $R_{29}$ each represents an alkyl group having from 1 to 5 carbon atoms or an aralkyl group having from 7 to 10 carbon atoms.

These groups represented by $R_{21}$ to $R_{29}$ are present two or more in the molecule represented by the general formula (A), (B) or (C) and at least one of these substituents present in the same molecule is an alkyl group or an aralkyl group each of which has a carboxy group, a salt thereof, a sulfo group, a salt thereof or a hydroxy group.

$X_1$, $X_2$ and $X_3$ each represents an acid anion (for example, a chloride anion, a bromide anion, an iodide anion, a p-toluenesulfonic acid anion, a perchloric acid anion, etc.).

l, m and n each represents 0 or 1 and when the compound is an inner salt, l, m or n represents 0.

The sensitizing dyes represented by the general formula (A), (B) or (C) which can be used in the present invention are known compounds and they can be synthesized with reference to the methods as described in F. M. Hamer, *Heterocyclic Compounds—Cyanine Dyes and Related Compounds, Chapter* 5, pages 116 to 147 (John Wiley and Sons, 1964), D. M. Sturmer, *Heterocyclic Compounds—Special Topics in Heterocyclic Chemistry, Chapter* 8, Item 5, pages 482 to 515 (John Wiley and Sons, 1977), Japanese Patent Publication Nos. 13823/68, 16589/69, 9966/73 and 4936/68, Japanese Patent Application (OPI) No. 82416/77, etc.

Specific examples of the sensitizing dyes represented by the general formula (A), (B) or (C) which can be employed in the present invention are set forth below, but the present invention should not be construed as being limited thereto.

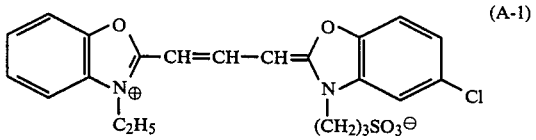
(A-1)

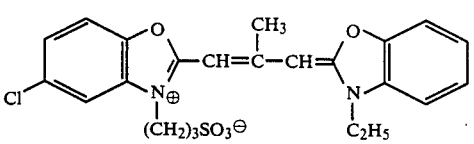
(A-2)

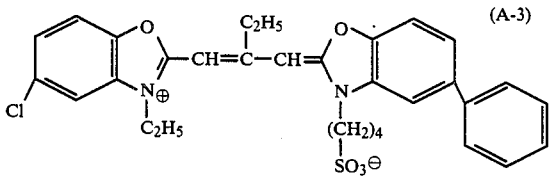
(A-3)

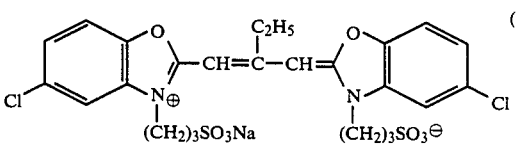
(A-4)

-continued
(A-5)
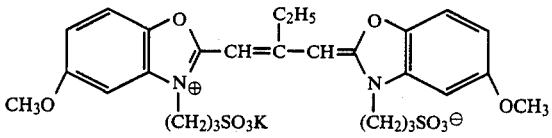
(A-6)
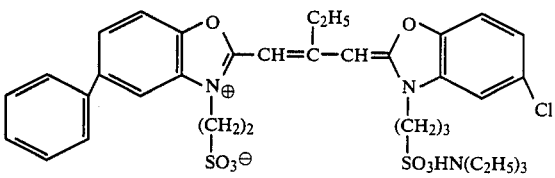
(A-7)
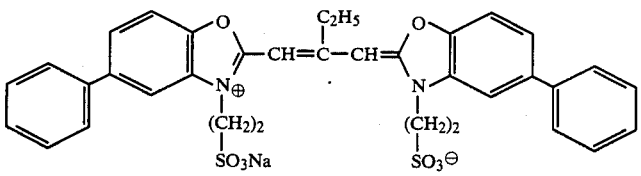
(A-8)
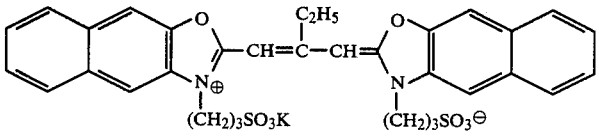
(A-9)
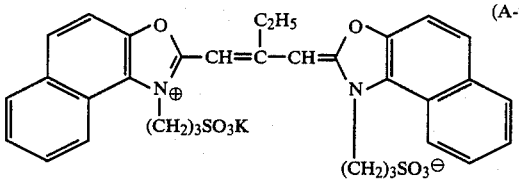
(A-10)
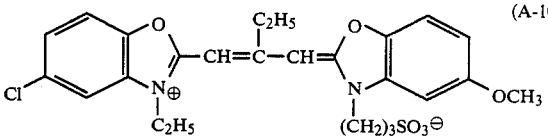
(A-11)
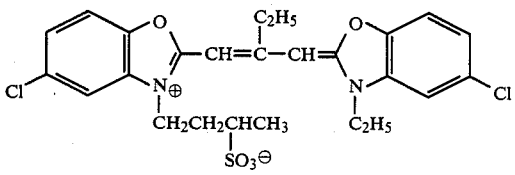
(A-12)
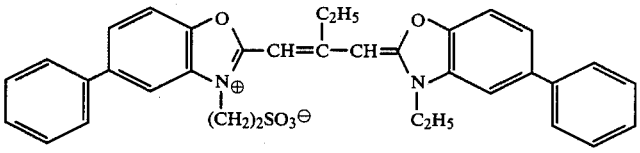
(A-13)
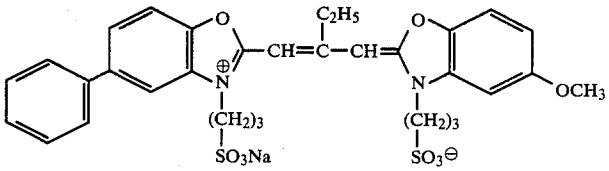
(A-14)
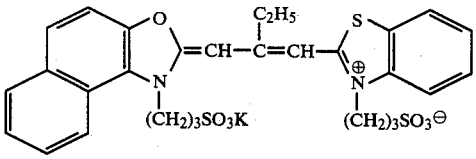
(A-15)
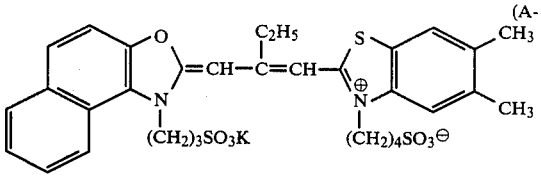
(A-16)
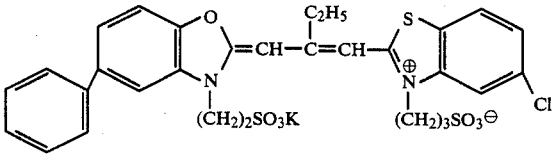
(A-17)
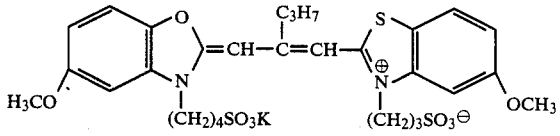

-continued
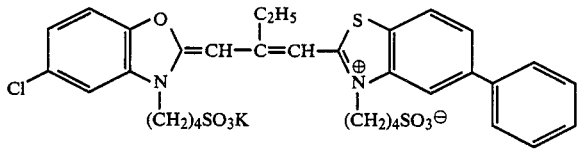
(A-18)
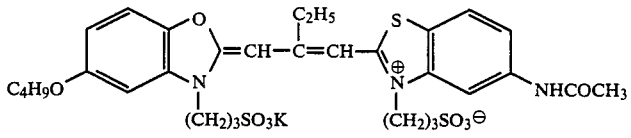
(A-19)
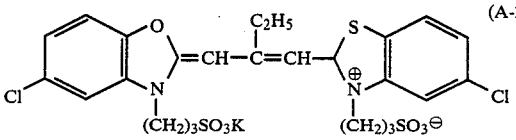
(A-20)
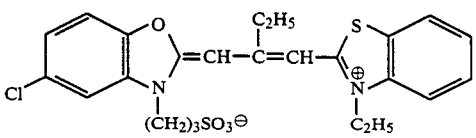
(A-21)
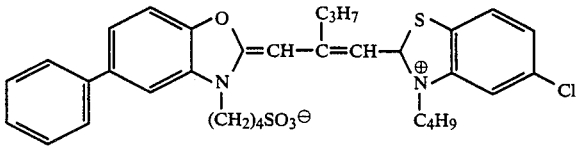
(A-22)
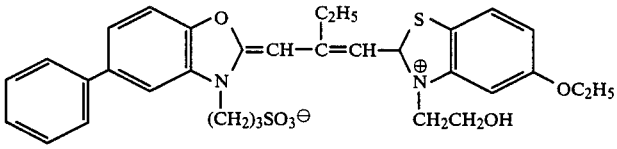
(A-23)
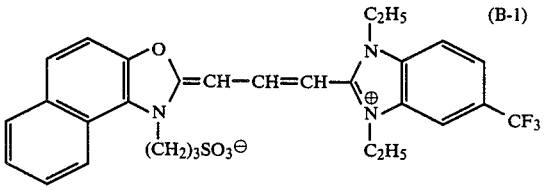
(B-1)
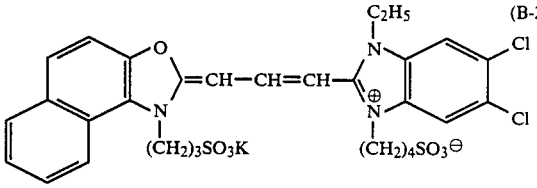
(B-2)
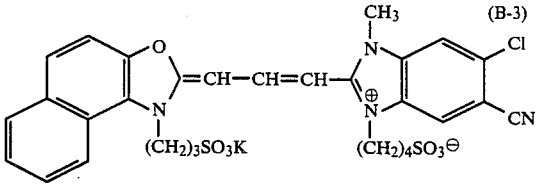
(B-3)
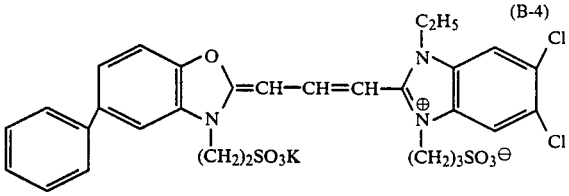
(B-4)
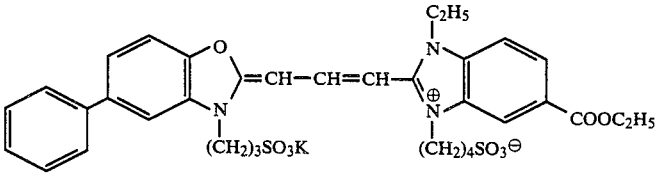
(B-5)

-continued
(B-6)
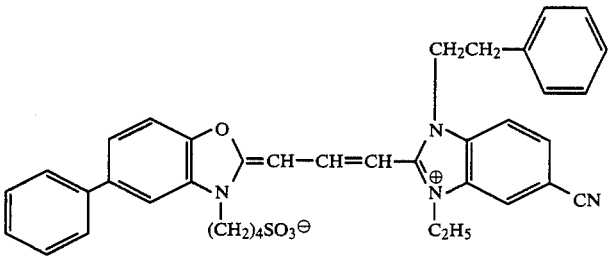
(B-7)
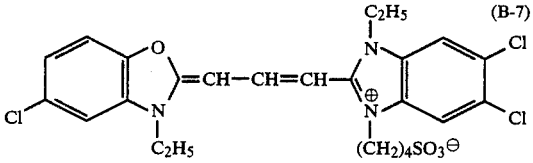
(B-8)
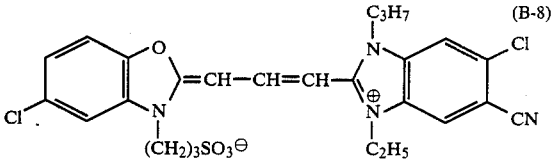
(B-9)
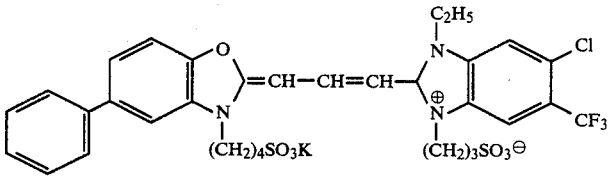
(C-1)
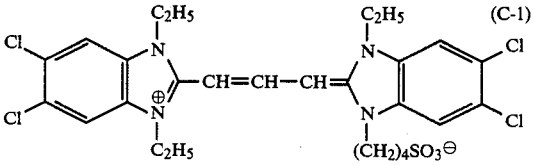
(C-2)
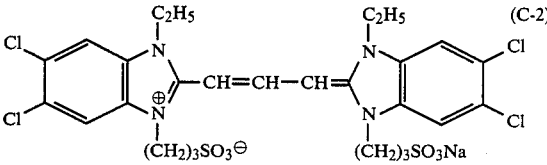
(C-3)
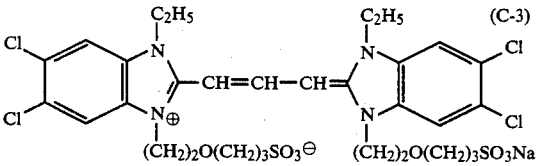
(C-4)
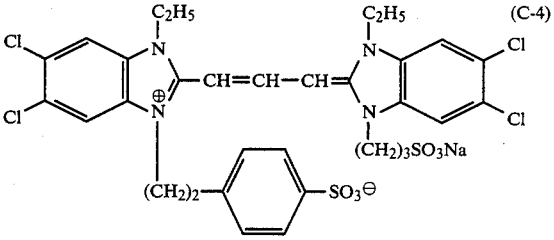
(C-5)
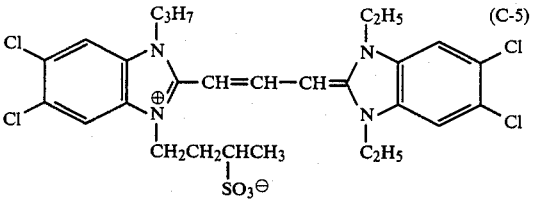
(C-6)
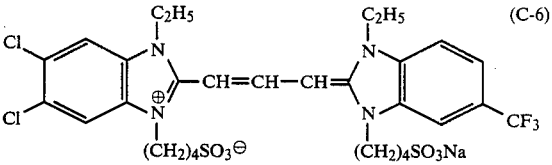
(C-7)
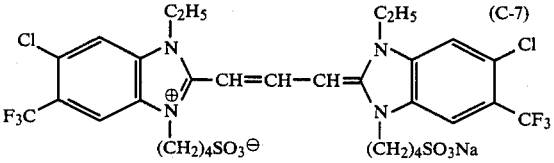
(C-8)
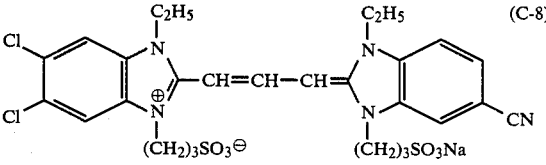

-continued

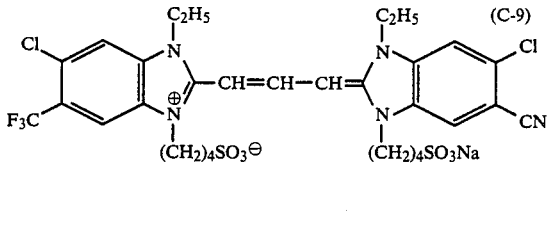
(C-9)

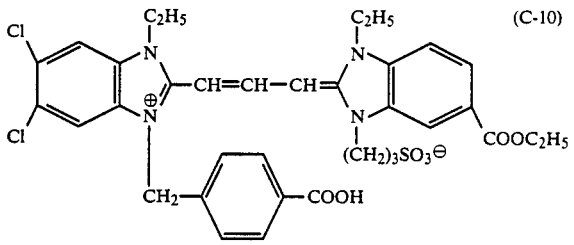
(C-10)

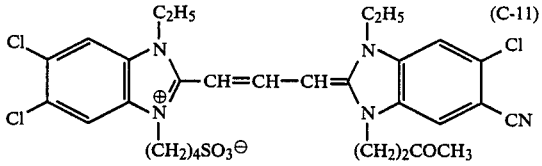
(C-11)

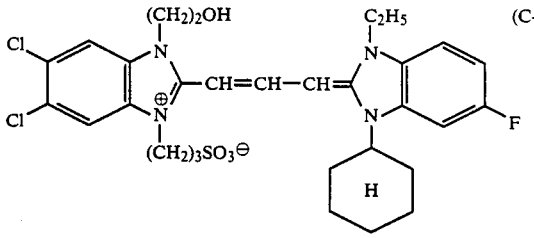
(C-12)

The sensitizing dye represented by the general formula (A), (B) or (C) used in the present invention is incorporated in a silver halide photographic emulsion in a content of $1\times10^{-6}$ mol to $1\times10^{-2}$ mol, preferably $1\times10^{-5}$ mol to $5\times10^{-3}$ mol, more preferably $4\times10^{-5}$ mol to $2.5\times10^{-3}$ mol, per mol of silver halide.

Two or more kinds of the sensitizing dyes represented by the general formulae (A), (B) and (C) can be employed together in the same silver halide emulsion layer, or the same sensitizing dye can be employed in different silver halide emulsion layer.

As the binder or the protective colloid which can be used in the photographic emulsion layers or intermediate layers of the photographic light-sensitive material according to the present invention, gelatin is advantageously used, but other hydrophilic colloids can be used alone or together with gelatin.

As gelatin in the present invention, not only lime-processed gelatin, but also acid-processed gelatin may be employed. The methods for preparation of gelatin are described in greater detail in Ather Veis, *The Macromolecular Chemistry of Gelatin,* Academic Press (1964).

In the photographic emulsion layer of the photographic light-sensitive material used in the present invention, any of silver bromide, silver iodobromide, silver iodochlorobromide, silver chlorobromide and silver chloride may be used as the silver halide.

Although the mean grain size of silver halide particles in the photographic emulsion) the mean grain size being determined from the grain diameter in those particles which are spherical or nearly spherical, and from the edge length in those particles which are cubic as a grain size, and is expressed as a mean value calculated from projected areas) is not particularly limited, but it is preferably 3 μm or less.

The distribution of grain size may be broad or narrow. Mono-dispersed emulsion (having a coefficient of variation of 20% or less) are preferably employed.

Silver halide particles in the photographic emulsion may have a regular crystal structure, e.g., a cubic, octahedral or tetradecahedral structure, an irregular crystal structure, e.g., a spherical or tabular structure, or a composite structure thereof. In addition, silver halide particles composed of those having different crystal structures may be used. Of these particles, those having a regular crystal structure are particularly preferably employed in the present invention.

Further, the photographic emulsion wherein at least 50% of the total projected area of silver halide particles is super tabular silver halide particles having a diameter at least five times their thickness may be employed.

The inner portion and the surface layer of silver halide particles may be different in phase. Silver halide particles may be those in which a latent image is formed mainly on the surface thereof, or those in which a latent image is formed mainly in the interior thereof.

The photographic emulsion used in the present invention can be prepared in any suitable manner, e.g., by the methods as described in P. Glafkides, *Chimie et Physique Photographique,* Paul Montel (1967), G. F. Duffin, *Photographic Emulsion Chemistry,* The Focal Press (1966), and V. L. Zelikman et al., *Making and Coating Photographic Emulsion,* The Focal Press (1964). That is, any of an acid process, a neutral process, an ammonia process, etc., can be employed.

Soluble silver salts and soluble halogen salts can be reacted by techniques such as a single jet process, a double jet process, and a combination thereof. In addition, there can be employed a method (a so-called reversal mixing process) in which silver halide particles are formed in the presence of an excess of silver ions.

As one system of the double jet process, a so-called controlled double jet process in which the pAg in a liquid phase where silver halide is formed is maintained at a predetermined level can be employed. This process can produce a silver halide emulsion in which the crystal form is regular and the grain size is nearly uniform.

Two or more kinds of silver halide emulsions which are prepared separately may be used as a mixture.

The formation or physical ripening of silver halide particles may be carried out in the presence of cadmium salts, zinc salts, lead salts, thallium salts, iridium salts or its complex salts, rhodium salts or its complex salts, iron salts or its complex salts, and the like.

Silver halide emulsions are usually chemically sensitized. For this chemical sensitization, for example, the methods as described in H. Frieser ed., *Die Grundlagen der Photographischen Prozesse mit Silberhalogeniden,* Akademische Verlagsgesellschaft, pages 675 to 734 (1968) can be used.

Namely, a sulfur sensitization process using active gelatin or compounds (e.g., thiosulfates, thioureas, mercapto compounds and rhodanines) containing sulfur capable of reacting with silver; a reduction sensitization process using reducing substances (e.g., stannous salts, amines, hydrazine derivatives, formamidinesulfinic acid, and silane compounds); a noble metal sensitization process using noble metal compounds (e.g., complex salts of the Group VIII metals in the Periodic Table, such as Pt, Ir and Pd, etc., as well as gold complex salts); and so forth can be applied alone or in combination with each other.

The photographic emulsion used in the present invention may include various compounds for the purpose of preventing fog formation or of stabilizing photographic characteristics in the photographic light-sensitive material during the production, storage or photographic processing thereof. For example, those compounds known as antifoggants or stabilizers can be incorporated including azoles such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly 1-phenyl-5-mercaptotetrazole), etc.; mercaptopyrimidines; mercaptotriazines; thioketo compounds such as oxazolinethione, etc.; azaindenes such as triazanidenes, tetraazaindenes (particularly 4-hydroxy-substituted (1,3,3a,7)tetraazaindenes), pentaazaindenes, etc.; benzenethiosulfonic acids; benzenesulfinic acids; benzenesulfonic amides; etc.

In the photographic emulsion layers or other hydrophilic colloid layers of the photographic light-sensitive material according to the present invention can be incorporated various surface active agents as coating aids or for other various purposes, e.g., prevention of charging, improvement of slipping properties, acceleration of emulsification and dispersion, prevention of adhesion, and improvement of photographic characteristics (for example, development acceleration, high contrast, and sensitization), etc.

The photographic emulsion layer of the photographic light-sensitive material according to the present invention may contain compounds such as polyalkylene oxide or its ether, ester, amine or the like derivatives, thioether compounds, thiomorpholines, quaternary ammonium salt compounds, urethane derivatives, urea derivatives, imidazole derivatives, and 3-pyrazolidones for the purpose of increasing sensitivity or contrast, or of accelerating development.

In the photographic emulsion layer or other hydrophilic colloid layers of the photographic light-sensitive material according to the present invention can be incorporated water-insoluble or sparingly soluble synthetic polymer dispersions for the purpose of improving dimensional stability, etc. Synthetic polymers which can be used include homo- or copolymers of alkyl acrylate or methacrylate, alkoxyalkyl acrylate or methacrylate, glycidyl acrylate or methacrylate, acrylamide or methacrylamide, vinyl esters (e.g., vinyl acetate), acrylonitrile, olefins, styrene, etc., and copolymers of the foregoing monomers and acrylic acid, methacrylic acid, $\alpha,\beta$-unsaturated dicarboxylic acid, hydroxyalkyl acrylate or methacrylate, sulfoalkyl acrylate or methacrylate, and styrenesulfonic acid, etc.

To the photographic emulsion used in the present invention, the above described sensitizing dyes can be added prior to coating on a support, if desired.

These sensitizing dyes can be employed individually, and can also be employed in combination. A combination of sensitizing dyes is often used particularly for the purpose of supersensitization.

The sensitizing dyes may be present in the emulsion together with dyes which themselves do not give rise to spectral sensitizing effects but exhibit a supersensitizing effect or materials which do not substantially absorb visible light but exhibit a supersensitizing effect. For example, aminostyryl compounds substituted with a nitrogen-containing heterocyclic group (e.g., those as described in U.S. Pat. Nos. 2,933,390 and 3,635,721, etc.), aromatic organic acid-formaldehyde condensates (e.g., those as described in U.S. Pat. No. 3,743,510, etc.), cadmium salts, azaindene compounds, and the like, can be present.

The present invention is also applicable to a multilayer multicolor photographic material containing layers sensitive to at least two different spectral wavelength ranges on a support. A multilayer natural color photographic material generally possesses at least one red-sensitive silver halide emulsion layer, at least one green-sensitive silver halide emulsion layer and at least one blue-sensitive silver halide emulsion layer, respectively, on a support. The order of these layers can be varied, if desired. Ordinarily, a cyan forming coupler is present in the red-sensitive emulsion layer, a magenta forming coupler is present in the green-sensitive emulsion layer and a yellow forming coupler is present in the blue-sensitive emulsion layer, respectively. However, if desired, a different combination can be employed.

In the same photographic silver halide emulsion layer or a different photographic silver halide emulsion layer or a light-sensitive layer of the photographic light-sensitive material according to the present invention can be incorporated, in addition to the coupler represented by the general formula (I) described above, other dye forming couplers, i.e., compounds capable of forming color upon oxidative coupling with aromatic primary amine developing agents (e.g., phenylenediamine derivatives, aminophenol derivatives, etc.) during the course of color development processing. Examples of such couplers include magenta couplers, such as 5-pyrazolone couplers, cyanoacetylcoumarone couplers and open chain acylacetonitrile couplers, etc., yellow couplers, such as acylacetamide couplers (e.g., benzoylacetanilides, pivaloylacetanilides, etc.), etc.; and cyan couplers, such as naphthol couplers and phenol couplers, etc. It is preferable to use nondiffusible couplers containing a hydrophobic group (a so-called ballast group) within the molecule or polymeric couplers. They may be either 4-equivalent or 2-equivalent with respect to silver ions. It is also possible to use colored couplers capable of exerting color correction effects, or couplers capable of releasing development inhibitors during the course of development (so-called DIR couplers).

Further, the photographic light-sensitive material may contain non-color-forming DIR coupling compounds which release a development inhibitor, the product of which formed by a coupling reaction is colorless, other than DIR couplers.

Moreover, the photographic light-sensitive material may contain compounds which release a development inhibitor during the course of development, other than DIR couplers.

Two or more kinds of the couplers according to the present invention and the above-described couplers and the like can be incorporated together in the same layer for the purpose of satisfying the properties required of the photographic light-sensitive material, or the same compound can naturally be added to two or more layers.

The photographic light-sensitive material of the present invention may contain inorganic or organic hardeners in the photographic emulsion layer and other hydrophilic colloid layers thereof. For example, chromium salts (e.g., chromium alum, chromium acetate, etc.), aldehydes (e.g., formaldehyde, glyoxal, glutaraldehyde, etc.), N-methylol compounds (e.g., dimethylolurea, methyloldimethylhydantoin, etc.), dioxane derivatives (e.g., 2,3-dihydroxydioxane, etc.), active vinyl compounds (e.g., 1,3,5-triacryloylhexahydro-s-triazine, 1,3-vinylsulfonyl-2-propanol, etc.), active halogen compounds (e.g., 2,4-dichloro-6-hydroxy-s-triazine, etc.), and mucohalogenic acids (e.g., mucochloric acid, mucophenoxychloric acid, etc.) can be used alone or in combination with each other.

In the photographic light-sensitive material of the invention, when dyes, ultraviolet light absorbing agents, and the like are incorporated in the hydrophilic colloid layers, they may be mordanted with cationic polymers, etc.

The photographic light-sensitive material of the present invention may contain therein hydroquinone derivatives, aminophenol derivatives, gallic acid derivatives, ascorbic acid derivatives, etc., a color fog preventing agents.

The hydrophilic colloid layers of the photographic light-sensitive material according to the present invention can contain ultraviolet light absorbing agents. For example, benzotriazole compounds substituted with aryl groups, 4-thiazolidone compounds, benzophenone compounds, cinnamic acid ester compounds, butadiene compounds or benzoxazole compounds can be employed. Ultraviolet light absorbing couplers (e.g., α-naphthol type cyan dye forming couplers) and ultraviolet light absorbing polymers can also be employed. These ultraviolet light absorbing agents can also be mordanted in a specific layer(s), if desired.

The photographic light-sensitive material of the present invention may contain water-soluble dyes in the hydrophilic colloid layers thereof as a filter dye or for various purposes, e.g., irradiation prevention and the like. Examples of such dyes include oxonol dyes, hemioxonol dyes, styryl dyes, merocyanine dyes, cyanine dyes, and azo dyes. In particular, oxonol dyes, hemioxonol dyes, and merocyanine dyes are useful.

In carrying out the present invention, known color fading preventing agents can be used together. Color image stabilizers can be used alone or in combination with each other. Typical known color fading preventing agents include hydroquinone derivatives, gallic acid derivatives, p-alkoxyphenols, p-oxyphenol derivatives, and bisphenols, etc.

In photographic processing of layers composed of photographic emulsions in the photographic light-sensitive material of the present invention, any of known procedures and known processing solutions, e.g., those are described in *Research Disclosure,* No. 176, pages 28 to 30 (December, 1978) can be used. The processing temperature is usually chosen from between 18° C. and 50° C., although it may be lower than 18° C. or higher than 50° C.

Color developing solutions are usually alkaline aqueous solutions containing color developing agents. As these color developing agents, known primary aromatic amine developing agents, e.g., phenylenediamines such as 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfoamidoethylaniline, 4-amino-3-methyl-N-ethyl-N-β-methoxyethylaniline, etc., can be used.

The color developing solutions can further contain pH buffering agents such as sulfites, carbonates, borates and phosphates of alkali metals, etc., developing inhibitors or antifogging agents such as bromides, iodides or organic antifogging agents, etc. In addition, if desired, the color developing solution can also contain water softeners; preservatives such as hydroxylamine, etc.; organic solvents such as benzyl alcohol, diethylene glycol, etc.; developing accelerators such as polyethylene glycol, quaternary ammonium salts, amines, etc.; dye forming couplers; competing couplers; fogging agents such as sodium borohydride; etc.; auxiliary developing agents such as 1-phenyl-3-pyrazolidone, etc.; viscosity imparting agents; polycarboxylic acid type chelating agents; antioxidizing agents; and the like.

After color development, the photographic emulsion layer is usually subjected to a bleach processing. This bleach processing may be performed simultaneously with a fix processing, or the bleach and fix processings may be performed independently.

Bleaching agents which can be used include compounds of polyvalent metals, e.g., iron (III), cobalt (III), chromium (VI), and copper (II), peracids, quinones and nitroso compounds. For example, ferricyanides; dichromates; organic complex salts of iron (III) or cobalt (III), e.g., complex salts of aminopolycarboxylic acids (e.g., ethylenediaminetetraacetic acid, nitrilotriacetic acid, 1,3-diamino-2-propanoltetraacetic acid, etc.) or organic acids (e.g., citric acid, tartaric acid, malic acid, etc.); persulfates; permanganates; nitrosophenol, etc., can be used. Of these compounds, potassium ferricyanide, iron (III) sodium ethylenediaminetetraacetate, and iron (III) ammonium ethylenediaminetetraacetate are particularly useful. Ethylenediaminetetraacetic acid iron (III) complex salts are useful in both an independent bleaching solution and a monobath bleach-fixing solution.

Any fixing solutions which have compositions generally used can be used in the present invention. As fixing agents, thiosulfuric acid salts and thiocyanic acid salts, and in addition, organic sulfur compounds which are known to be effective as fixing agents can be used. These fixing solutions may contain water-soluble aluminum salts as hardeners.

Dyes formed from the magenta couplers represented by the general formula (I) according to the present invention are excellent in that undesirable secondary absorptions in the red light region and the blue light region are small, that the dyes are fast in a dark place and under light exposure, and that strain occurrance in white background areas is little, etc. However, when these couplers are employed together with photographic silver halide emulsions which are prepared using a method for addition of sensitizing dyes other than the present invention, a decrease in sensitivity is apt to occur and such a tendency greatly increases in case when the photographic emulsion is allowed to stand for a long time before coating during production or during preservation of photographic light-sensitive materials after coating. This is a severe problem in practical use.

However, in accordance with the present invention, photographic light-sensitive materials having a layer containing the magenta coupler represented by the general formula (I) and a silver halide emulsion prepared by adding sensitizing dyes prior to the completion of formation of silver halide particles do not cause such a disadvantageous decrease in sensitivity and exhibit the excellent properties of the magenta couplers.

The present invention will be explained in greater detail with reference to the following examples, but the present invention should not be construed as being limited thereto.

Unless otherwise specified, all ratios, percents, etc. are by weight.

EXAMPLE 1

A mixture of 10 g of Compound (M-11), 2 ml of tri-n-octyl phosphate (TOP) and 20 ml of ethyl acetate was dissolved and the resulting solution was emulsified in 80 ml of a 10% aqueous solution of gelatin containing 10 ml of a 1% aqueous solution of sodium dodecylbenzenesulfonate to prepare an emulsion which was designated Emulsion (a).

Also, Emulsion (b) was prepared in the same manner as described above except using 10.2 g of Compound (M-19) in place of Compound (M-11).

Further, Emulsion (c) was prepared in the same manner as described above except using 14.6 g of Comparison Magenta Coupler (M-a) shown below in place of Compound (M-11).

Comparison Magenta Coupler (M-a)

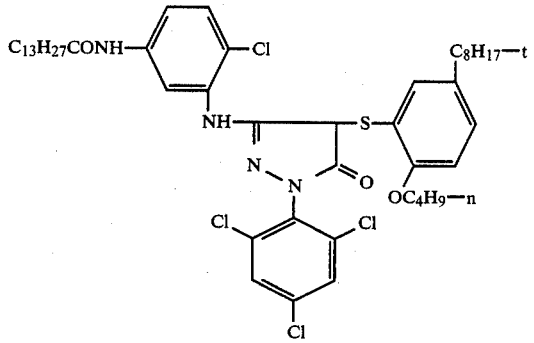

On the other hand, a silver chlorobromide emulsion (bromide content: 50 mol%; silver content: 66.0 g per Kg of the emulsion) was prepared in the following manner. That is, an aqueous solution of gelatin containing $10^{-3}$N of potassium bromide was maintained at 60° C., to which were simultaneously added a 1N aqueous solution of silver nitrate and an aqueous solution containing 0.5N of potassium bromide and 0.5N of sodium chloride over 60 minutes at an equal addition rate while stirring thoroughly, and at the time when 90% of the whole aqueous solution of silver nitrate was added, as green sensitizing dye, Dye (A-7) was added in an amount of $2.5\times10^{-4}$ mols per mol of silver chlorobromide to the reaction system. After the completion of a particle formation step and a desalting step, the optimum amount of an aqueous solution of sodium thiosulfate was added to the emulsion and sulfur sensitization was conducted to prepare a green-sensitive silver chlorobromide emulsion.

To each 135 g of the green-sensitive silver halide emulsion was added the total amount of Emulsion (a), (b) or (c) described above to prepare Emulsions (I), (II) and (III) respectively.

Further, a silver chlorobromide emulsion was prepared in the same manner as described above except that the green sensitizing dye was not added during the preparation. To each 135 g of the silver chlorobromide emulsion was added the above described Dye (A-7) in an amount of $2.5\times10^{-4}$ mols per mol of silver chlorobromide and then the total amount of Emulsion (a), (b) or (c) described above was added to prepare Emulsions (IV), (V) and (VI) respectively.

These Emulsions (I) to (VI) were allowed to stand in a thermal bath maintained at 40° C. for 6 hours with stirring. Then, 2,4-dichloro-6-hydroxy-s-triazine sodium salt was added thereto as a hardening agent and each of the emulsions was coated on a cellulose triacetate film support in a silver coated amount of 500 mg/m$^2$. On the emulsion layer was coated an aqueous solution of gelatin containing the same hardening agent as described above whereby Samples I to VI were prepared.

Each of the film samples was exposed to blue light and green light through a continuous wedge and subjected to the following development processing to obtain a magenta color image.

| Processing Step | Temperature (°C.) | Time |
|---|---|---|
| Color Development | 33 | 3 min 30 sec |
| Bleach-Fixing | 33 | 1 min 30 sec |
| Washing with water | 25 to 35 | 3 min |
| Drying | 80 | |

The composition of each processing solution was as follows.

| Color Development Solution | |
|---|---|
| Trisodium nitrilotriacetate | 2.0 g |
| Benzyl alcohol | 15 ml |
| Diethylene glycol | 10 ml |
| Sodium sulfite | 2.0 g |
| Potassium bromide | 0.5 g |
| Hydroxylamine sulfate | 3.0 g |
| 4-Amino-3-methyl-N—ethyl-N—[β-methanesulfonamido)ethyl]-p-phenylenediamine sulfate | 5.0 g |
| Sodium carbonate (monohydrate) | 30 g |
| Water to make | 1,000 ml (pH: 10.1) |

| Bleach-Fixing Solution | |
|---|---|
| Ammonium thiosulfate (70 wt % soln.) | 150 ml |
| Sodium sulfate | 15 g |
| Ammonium ethylenediaminetetraacetate iron (III) | 55 g |
| Disodium ethylenediaminetetraacetate | 4 g |
| Water to make | 1,000 ml |

The optical density to green light was measured with each of these samples thus processed and the results shown in Table 1 were obtained.

TABLE 1

| Sample | Magenta Coupler | Sensitivity* Blue Light (inherent region) | Sensitivity* Green Light (sensitized region) | Method for Addition of Sensitizing Dye |
|---|---|---|---|---|
| I | (M-11) | 99 | 97 | Method of Present Invention |
| II | (M-19) | 98 | 98 | Method of Present Invention |
| III | (M-a) (Comparison) | 100 | 100 | Method of Present Invention |
| IV | (M-11) | 82 | 63 | Comparison Method |
| V | (M-19) | 75 | 65 | Comparison Method |
| VI | (M-a) (Comparison) | 96 | 95 | Comparison Method |

*Sensitivity is shown by a reciprocal of the exposure amount required for obtaining an optical density of fog + 0.2 and the sensitivities of Sample III are taken as 100 respectively and the other sensitivities are shown relatively.

From the results shown in Table 1, it is apparent that in the cases wherein the pyrazoloazole type magenta couplers represented by the general formula (I) were used in the silver chlorobromide emulsion to which the green sensitizing dye was added as finals just before coating, the sensitivities were remarkably decreased both in the inherent region to blue light and in the sensitized region to green light (see Samples IV and V) in comparison with the case of using known Coupler (M-a).

On the contrary, in the case of using the silver chlorobromide emulsion to which the green sensitizing dye was added prior to the completion of silver halide particle formation, almost the same sensitivities as using the known coupler were obtained (see Samples I and II).

EXAMPLE 2

Using 10.3 g of Compound (M-13), 2.1 mol of tri-n-octyl phosphate and 20 ml of ethyl acetate, Emulsion (d) was prepared in the same manner as described in Example 1. Also, Emulsion (e) was prepared in the same manner as described above except that 11.1 g of Compound (M-16) was used in place of Compound (M-13) and the amount of tri-n-octyl phosphate was changed to 2.2 ml.

For comparison, using 14.6 g of Comparison Magenta Coupler (M-a) and 2.9 ml of tri-n-octyl phosphate, 9.9 g of Comparison Magenta Coupler (M-b) shown below and 2.0 ml of tri-n-octyl phosphate, and 11.2 g of Comparison Magenta Coupler (M-c) shown below and 2.2 ml of tri-n-octyl phosphate, Emulsions (f), (g) and (h) were prepared in the same manner as described above.

Comparison Magenta Coupler (M-b)

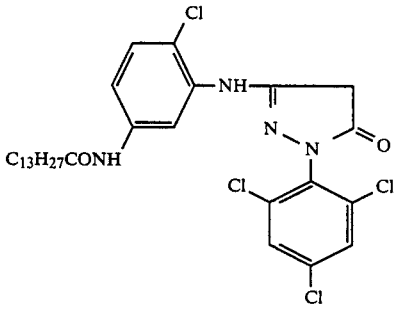

Comparison Magenta Coupler (M-c)

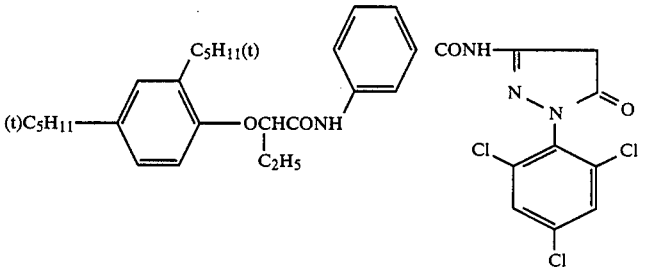

Further, only 2.5 ml of tri-n-octyl phosphate was emulsified in the same manner as described above to prepare Emulsion (i).

A silver chlorobromide emulsion was prepared in a manner similar to that in Example 1 but the sensitizing dye was added intermittently during the preparation of silver halide particles. More specifically, a methanol solution of the same sensitizing dye as used in Example 1, i.e., Green Sensitizing Dye (A-7) prepared by dissolving it in an amount corresponding to $2.5\times10^{-4}$ mols per mol of silver chlorobromide was divided into 10 portions and each portion was added to the reaction system at each of the time when 0, 10, 20, 30, 40, 50, 60, 70, 80 or 90% of the whole aqueous solution of silver nitrate was added. To the green-sensitive silver chlorobromide emulsion were added each of the above described Emulsions (d), (e), (f), (g), (h) and (i) and the same hardening agent as described in Example 1, and the resulting photographic emulsions were coated on a support both surfaces of which were laminated with polyethylene in a silver coated amount of 200 mg/m$^2$ to prepare Samples VII, VIII, IX, X, XI and XII, respectively.

On the other hand, a silver chlorobromide emulsion was prepared in a similar manner without the addition of sensitizing dye during the formation of silver halide particles and then a methanol solution containing the above described sensitizing dye in an amount corresponding to $2.5\times10^{-4}$ mols per mol of silver halide, each of the above described Emulsions (d) to (i) and the above described hardening agent were added to the emulsion. The resulting photographic emulsions were coated on a support both surfaces of which were laminated with polyethylene in a silver coated amount of 200 mg/m$^2$ to prepare Samples XIII, XIV, XV, XVI, XVII and XVIII, respectively.

These Samples VII to XVIII were divided to two parts and one part thereof was stored at 25° C. and 60% RH for 3 days, and the other part thereof was stored at 40° C. and 80% RH for 3 days. Then these samples were exposed to blue light and green light through a continuous wedge and subjected to development processing in the same manner as described in Example 1 to obtain magenta images.

The optical density to green light was measured with each of these samples thus processed and the results shown in Table 2 were obtained.

TABLE 2

| Sample | Magenta Coupler | Sensitivity* Blue Light (inherent region) 25° C., 60% RH | 40° C., 80% RH | Green Light (sensitized region) 25° C., 60% RH | 40° C., 80% RH | Method for Addition of Sensitizing Dye |
|---|---|---|---|---|---|---|
| VII | (M-13) | 98 | 100 | 99 | 97 | Method of Present Invention |
| VIII | (M-16) | 99 | 100 | 101 | 98 | Method of Present Invention |
| IX | (M-a) | 100 | 99 | 100 | 98 | Method of Present Invention |
| X | (M-b) | 101 | 101 | 99 | 99 | Method of Present Invention |
| XI | (M-c) | 99 | 98 | 99 | 100 | Method of Present Invention |
| XII | — | — | — | — | — | Method of Present Invention |
| XIII | (M-13) | 93 | 92 | 91 | 83 | Comparison Method |
| XIV | (M-16) | 92 | 94 | 92 | 85 | Comparison Method |
| XV | (M-a) | 99 | 101 | 101 | 100 | Comparison Method |
| XVI | (M-b) | 101 | 100 | 99 | 96 | Comparison Method |
| XVII | (M-c) | 98 | 99 | 101 | 102 | Comparison Method |
| XVIII | — | — | — | — | — | Comparison Method |

*Sensitivity is shown by a reciprocal of the exposure amount required for obtaining an optical density of fog + 0.5 and the sensitivities of Sample IX stored at 25° C. and 60% RH are taken as 100 and the other sensitivities are shown relatively.

From the results shown in Table 2, it is apparent that in the cases wherein the pyrazoloazole type magenta couplers were used in the green-sensitive silver halide emulsion which was prepared by adding the green sensitizing dye as finals, the sensitivities were remarkably decreased. However, when the pyrazoloazole type magenta couplers were used in the green-sensitive silver halide emulsion which was prepared by adding the green sensitizing dye prior to the completion of formation of silver halide particles, the decreases in sensitivity was hardly observed.

On the other hand, the pyrazoloazole type magenta couplers provided bright color images in comparison with those obtained from known couplers. Therefore, it can be understood that the most excellent properties are obtained by using the pyrazoloazole type magenta couplers in the green-sensitive silver halide emulsion prepared by adding the green sensitizing dye prior to the completion of formation of silver halide particles.

EXAMPLE 3

Emulsion (j) was prepared in the same manner as described in Example 1 using 10.0 g of Compound (M-11) and 10 ml of tri-n-octyl phosphate.

Also, Emulsion (k) was prepared in the same manner as described above except using 14.6 g of Comparison Magenta Coupler (M-a) in place of Compound (M-11).

On the other hand, a silver chlorobromide emulsion (bromide content: 70 mol%; silver content: 66.0 g per Kg of the emulsion) was prepared in the following manner. That is, an aqueous solution of gelatin containing $10^{-3}$N of potassium bromide was maintained at 65° C., to which were added simultaneously a 1N aqueous solution of silver nitrate and an aqueous solution containing 0.7N of potassium bromide and 0.3N of sodium chloride over 40 minutes at an equal addition rate with stirring thoroughly, and at the time when 95% of the whole aqueous solution of silver nitrate was added, as green sensitizing dye, Dye (A-7), (C-1) or (B-4) was added in an amount of $2.5\times10^{-4}$ mols per mol of silver chlorobromide to the reaction system. After the completion of the particle formation step and the desalting step, the optimum amount of an aqueous solution of sodium thiosulfate was added to the emulsion and sulfur sensitization was conducted to prepare a green-sensitive silver chlorobromide emulsion.

To each 135 g of the green-sensitive silver halide emulsion was added the total amount of Emulsion (j) or (k) described above to prepare coating solutions.

Further, for comparison, a silver chlorobromide emulsion was prepared in the same manner as described above except that the green sensitizing dye was not added during the preparation. To each 135 g of the silver chlorobromide emulsion was added the total amount of Emulsion (j) or (k) described above and finally the above described green sensitizing dye was added thereto in the same amount as described above to prepare coating solutions.

The resulting coating solutions were allowed to stand in a thermal bath maintained at 40° C. for 4 hours with stirring as described in Example 1. Then, the same hardening agent was added to each of the coating solutions and each solution was coated in the same manner as described in Example 1 to prepare Samples XIX to XXX.

Each of these film samples was exposed to blue light and green light through a continuous wedge and subjected to development processing in the same manner as described in Example 1 to obtain magenta images.

The optical density to green light was measured with each of these samples thus processed and the results shown in Table 3 were obtained.

TABLE 3

| Sample | Magenta Coupler | Green Sensitizing Dye | Sensitivity* Blue Light (inherent region) | Sensitivity* Green Light (sensitized region) | Method for Addition of Sensitizing Dye |
|---|---|---|---|---|---|
| XIX | (M-11) | (A-7) | 101 | 99 | Method of Present Invention |
| XX | (M-a) (Comparison) | " | 100 | 100 | Method of Present Invention |
| XXI | (M-11) | (C-1) | 98 | 97 | Method of Present Invention |
| XXII | (M-a) (Comparison) | " | 100 | 100 | Method of Present Invention |
| XXIII | (M-11) | (B-4) | 97 | 99 | Method of Present Invention |
| XXIV | (M-a) (Comparison) | " | 100 | 100 | Method of Present Invention |
| XXV | (M-11) | (A-7) | 90 | 83 | Comparison Method |
| XXVI | (M-a) (Comparison) | " | 100 | 100 | Comparison Method |
| XXVII | (M-11) (Comparison) | (C-1) | 89 | 81 | Comparison Method |
| XXIX | (M-11) | (B-4) | 89 | 85 | Comparison Method |
| XXX | (M-a) (Comparison) | " | 100 | 100 | Comparison Method |

*Sensitivity is shown by a reciprocal of the exposure amount required for obtaining an optical density of fog + 0.5 and the sensitivities to blue light and green light of Samples XX, XXII, XXIV, XXVI, XXVIII and XXX each containing Emulsion (k) of known coupler are taken as 100 and the other sensitivities are shown relatively in order to compare the differences of sensitivities due to the magenta coupler employed.

From the results obtained in Table 3 it is apparent that in the cases wherein the pyrazoloazole type magenta couplers were used in the green-sensitive silver halide emulsion which was prepared by adding the green sensitizing dye as final, the sensitivities were remarkably decreased (see Samples XXV, XXVII and XXIX). However, when the pyrazoloazole type magenta couplers were used in the green-sensitive silver halide emulsion which was prepared by adding the green sensitizing dye prior to the completion of formation of silver halide particles, a decrease in sensitivity was hardly observed (see Samples XIX, XXI and XXIII).

On the other hand, the pyrazoloazole type magenta couplers provided bright color images in comparison with those obtained from known couplers. Therefore, it can be understood that the most excellent properties are obtained by using the pyrazoloazole type magenta couplers in the green-sensitive silver halide emulsion prepared by adding the green sensitizing dye prior to the completion of formation of silver halide particles.

EXAMPLE 4

Emulsions (a), (b) and (c) were prepared in the same manner as described in Example 1.

On the other hand, a silver iodobromide emulsion (iodide content: 3 mol%; silver content: 66.0 g per Kg of the emulsion) was prepared in the following manner. That is, an aqueous solution of gelatin containing 0.1% ammonia as a solvent was maintained at 50° C., to which were added simultaneously a 1N aqueous solution of silver nitrate and an aqueous solution containing 0.97N of potassium bromide and 0.03N of potassium iodide over 40 minutes with stirring thoroughly while maintaining a silver potential in the reaction solution at +50 mV, and at the same time when 90% of the whole aqueous solution of silver nitrate was added, as green sensitizing dye, Dye (A-7) was added in an amount of $2.5\times10^{-4}$ moles per mol of silver iodobromide to the reaction system. After the completion of a particle formation step and a desalting step, the optimum amounts of sodium thiosulfate, auric chloride and sodium thiocyanate were added to the emulsion and sulfur sensitization and gold sensitization was conducted to prepare a green-sensitive silver iodobromide emulsion.

To each 135 g of the green-sensitive silver halide emulsion was added the total amount of Emulsion (a), (b) or (c) described above to prepare Emulsions (XXXI), (XXXII) and (XXXIII) respectively.

Further, a silver iodobromide emulsion was prepared in the manner as described above except that the green sensitizing dye was not added during the preparation. To each 135 g of the silver iodobromide emulsion was added the total amount of Emulsion (a), (b) or (c) described above and finally the above described green sensitizing dye was added thereto just after coating in an amount of $2.5\times10^{-4}$ mols per mol of silver iodobromide to prepare Emulsions (XXXIV), (XXXV) and (XXXVI) respectively.

These Emulsions (XXXI) to (XXXVI) were subjected to a thermal test in the same manner as described in Example 1, then the same hardening agent was added to each of the emulsions and the resulting coating solutions were coated in the same manner as described in Example 1 to prepare Samples XXXI to XXXVI.

Each of these samples was exposed to blue light and green light and subjected to development processing in the same manner as described in Example 1 to obtain magenta images. The optical density to green light was measured with each of these samples thus processed and the results shown in Table 4 were obtained.

TABLE 4

| Sample | Magenta Coupler | Sensitivity* Blue Light (inherent region) | Sensitivity* Green Light (sensitized region) | Method for Addition of Sensitizing Dye |
|---|---|---|---|---|
| XXXI | (M-11) | 97 | 99 | Method of Present Invention |
| XXXII | (M-19) | 99 | 98 | Method of Present Invention |
| XXXIII | (M-a) (Comparison) | 100 | 100 | Method of Present Invention |
| XXXIV | (M-11) | 79 | 68 | Comparison Method |
| XXXV | (M-19) | 80 | 71 | Comparison Method |
| XXXVI | (M-a) (Comparison) | 97 | 96 | Comparison Method |

*Sensitivity is shown by a reciprocal of the exposure amount required for obtaining an optical density of fog + 0.2 and the sensitivities of Sample XXXIII are taken as 100 respectively and the other sensitivities are shown relatively.

From the results shown in Table 4 it is apparent that in the cases wherein the pyrazoloazole type magenta couplers represented by the general formula (I) were used in the silver iodobromide emulsion to which the green sensitizing dye was added as finals, the sensitivities were remarkably decreased both in the inherent region to blue light and in the sensitized region to green light (see Samples XXXIV and XXXV) in comparison with the case of using known Coupler (M-a).

On the contrary, in case of using the silver iodobromide emulsion to which the green sensitizing dye was added prior to the completion of silver halide particle formation, almost the same sensitivities as using the known coupler were obtained (see Samples XXXI and XXXII).

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material comprising a support having thereon at least one silver halide emulsion layer, wherein the silver halide emulsion layer contains a silver halide emulsion which is spectrally sensitized by adding a spectral sensitizing dye prior to the completion of formation of silver halide particles and at least one kind of pyrazoloazole type magenta coupler represented by the following general formula (I):

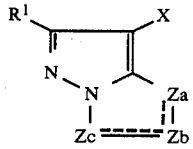

(I)

wherein $R^1$ represents a hydrogen atom or a substituent; X represents a hydrogen atom or a group capable of being released upon a coupling reaction with an oxidation product of an aromatic primary amine developing agent; Za, Zb and Zc each represents a methine group, a substituted methine group, =N— or —NH—, one of the Za—Zb bond and the Zb—Zc bond being a double bond and the other being a single bond, and when the Zb—Zc bond is a carbon-carbon double bond, it may form a part of an aromatic ring; $R^1$ or X may also form a polymer including a dimer or more; and when Za, Zb or Zc is a substituted methine group, the substituted methine group may form a polymer including a dimer or more.

2. A silver halide color photographic light-sensitive material as claimed in claim 1, wherein the polymer of the pyrazoloazole type coupler is a bis coupler or a polymer coupler.

3. A silver halide color photographic light-sensitive material as claimed in claim 1, wherein the pyrazoloazole type coupler is represented by the following general formula (II), (III), (IV) or (V):

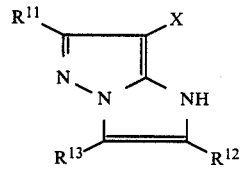

[II]

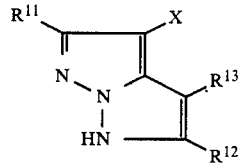

[III]

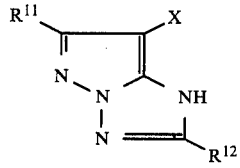

[IV]

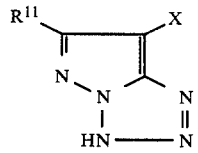

[V]

wherein $R^{11}$, $R^{12}$ and $R^{13}$, which may be the same or different, each represents a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or an aryloxycarbonyl group which may be bonded through a linking group, or $R^{12}$ and $R^{13}$ in the general formula (II) or (III) may combine with each other to form a 5-membered, 6-membered or 7-membered ring; X represents a hydrogen atom, a halogen atom, a carboxy group or a group capable of being released upon coupling which is bonded to the carbon atom at the coupling position through an oxygen atom, a nitrogen atom or a sulfur atom; or $R^{11}$, $R^{12}$, $R^{13}$ or X is a divalent group to form a bis coupler.

4. A silver halide color photographic light-sensitive material as claimed in claim 3, wherein the pyrazoloazole type coupler is a polymer coupler in which the coupler moiety derived from the coupler represented by general formula (II), (III), (IV) or (V) is present at the main chain or the side chain of a polymer.

5. A silver halide color photographic light-sensitive material as claimed in claim 3, wherein the divalent group to form a bis coupler represented by $R^{11}$, $R^{12}$ or $R^{13}$ is a substituted or unsubstituted alkylene group, a substituted or unsubstituted phenylene group, a group of the formula —NHCO—$R^{14}$—CONH— group, wherein $R^{14}$ represents a substituted or unsubstituted alkylene group or a substituted or unsubstituted phenylene group, or a group of the formula —S—$R^{14}$—S—, wherein $R^{14}$ represents a substituted or unsubstituted alkylene group.

6. A silver halide color photographic light-sensitive material as claimed in claim 4, wherein the polymer coupler is a homopolymer.

7. A silver halide color photographic light-sensitive material as claimed in claim 4, wherein the polymer coupler is a copolymer.

8. A silver halide color photographic light-sensitive material as claimed in claim 3, wherein the pyrazoloazole type coupler is represented by the general formula (II) or (IV).

9. A silver halide color photographic light-sensitive material as claimed in claim 1, wherein an amount of the pyrazoloazole type coupler represented by the general formula (I) is in a range from $1\times10^{-3}$ mol to $5\times10^{-1}$ moles per mol of silver halide present in the silver halide emulsion layer.

10. A silver halide color photographic light-sensitive material as claimed in claim 1, wherein the spectral sensitizing dye is a cyanine dye, a merocyanine dye, a complex cyanine dye, a complex merocyanine dye, a holopolar cyanine dye, a hemicyanine dye, a styryl dye or a hemioxonol dye.

11. A silver halide color photographic light-sensitive material as claimed in claim 10, wherein the spectral sensitizing dye is a cyanine dye, a merocyanine dye or a complex merocyanine dye.

12. A silver halide color photographic light-sensitive material as claimed in claim 1, wherein the spectral sensitizing dye is represented by the following general formula (A), (B) or (C):

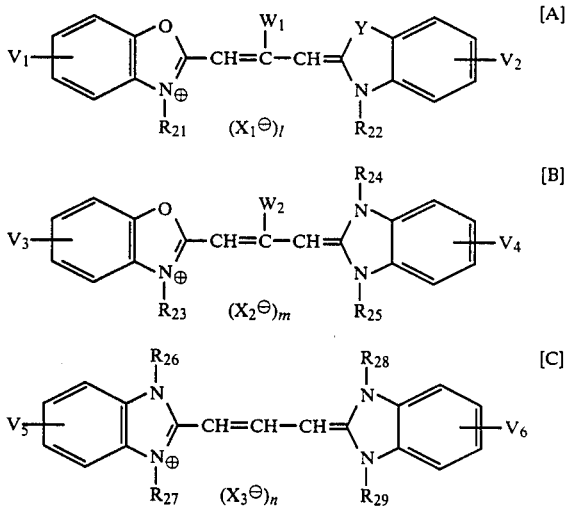

wherein $W_1$ and $W_2$ each represents a hydrogen atom or an alkyl group; $V_1$, $V_2$, $V_3$ and $V_4$, which may be the same or different, each represents a hydrogen atom, a halogen atom, an alkyl group, an aryl group, an alkoxy group, an amido group, an alkoxycarbonyl group, a cyano group, or a condensed benzene ring; $V_5$ and $V_6$, which may be the same or different, each represents a hydrogen atom, a halogen atom, an alkyl group, an alkoxy group, an amido group, an alkoxycarbonyl group or a cyano group; two or more of the substituents represented by $V_1$, $V_2$, $V_3$, $V_4$, $V_5$ or $V_6$ may be present in the molecules; $R_{21}$, $R_{22}$, $R_{23}$, $R_{24}$, $R_{25}$, $R_{26}$, $R_{27}$, $R_{28}$ and $R_{29}$, which may be the same or different, each represents an alkyl group or an aralkyl group, provided that at least one of $R_{21}$ and $R_{22}$, $R_{23}$, $R_{24}$ and $R_{25}$ or $R_{26}$, $R_{27}$, $R_{28}$ and $R_{29}$ represents an alkyl or aralkyl group having a sulfo group, a salt thereof, a carboxy group, a salt thereof or a hydroxy group; Y represents an oxygen atom or a sulfur atom; $X_1$, $X_2$ and $X_3$ each represents an acid anion; and l, m and n each represents 0 or 1, when the compound is an inner salt, l, m or n is 0.

13. A silver halide color photographic light-sensitive material as claimed in claim 12, wherein an amount of the spectral sensitizing dye is in a range from $1\times10^{-6}$ mol to $1\times10^{-2}$ mol per mol of silver halide.

14. A silver halide color photographic light-sensitive material as claimed in claim 1, wherein the silver halide emulsion is chemically sensitized.

* * * * *